US006173684B1

(12) United States Patent
Buehrle, II et al.

(10) Patent No.: US 6,173,684 B1
(45) Date of Patent: Jan. 16, 2001

(54) INTERNAL COMBUSTION VALVE OPERATING MECHANISM

(76) Inventors: Harry W. Buehrle, II, 14 Alegria, Irvine, CA (US) 92620; Raymond C. Clark, 5861 Woodboro Dr., Huntington Beach, CA (US) 92649; Jarrid Gross, 3925 Bonita Dr., Fullerton, CA (US) 92835; Ron Long, 12781 Aspenwood La., Garden Grove, CA (US) 92840; Lance E. Nist, 2824 S. Willis St., Santa Ana, CA (US) 92705

( * ) Notice: Under 35 U.S.C. 154(b), the term of this patent shall be extended for 0 days.

(21) Appl. No.: 09/480,098

(22) Filed: Jan. 10, 2000

Related U.S. Application Data

(63) Continuation of application No. 09/092,445, filed on Jun. 5, 1998, now Pat. No. 6,024,060.

(51) Int. Cl.[7] ..... F01L 9/02
(52) U.S. Cl. ..... 123/90.12
(58) Field of Search ..... 123/90.11, 90.12, 123/90.13, 308, 406.58, 612, 617

(56) References Cited

U.S. PATENT DOCUMENTS

D. 247,717 4/1978 Sturman et al. .
D. 258,140 2/1981 Sturman et al. .

(List continued on next page.)

OTHER PUBLICATIONS

Sae Technical Paper Series, No. 960581, International Congress & Exposition, Feb. 26–29, 1996, "Camless Engine", Michael M. Schechter & Michael B. Levin, Ford Research Lab., (3 pages).

Machine Design, Jun. 18, 1998, p. 25, News off the Wire, Daimler–Benz Research in Germany, Electrohydraulic Valves Replace Camshafts.

* cited by examiner

*Primary Examiner*—Weilun Lo
(74) *Attorney, Agent, or Firm*—Fulwider Patton Lee & Utecht, LLP; James W. Paul, Esq.

(57) ABSTRACT

The reciprocating valve actuation and control system includes a poppet valve moveable between a first and second position; a source of pressurized hydraulic fluid; a hydraulic actuator including an actuator piston coupled to the poppet valve and reciprocating between a first and second position responsive to flow of the pressurized hydraulic fluid to the hydraulic actuator; an electrically operated valve controlling flow of the pressurized hydraulic fluid to the actuator; and an engine computer that generates electrical pulses to control the electrically operated valve. The electrically operated valve preferably comprises a three path rotary latched magnetic motor actuating a rotary valve portion having a housing, a rotor, and a stator receiving and supplying hydraulic fluid pressure to the rotor, which alternately directs the hydraulic fluid pressure to the valve cylinder for opening of the valve, or to return to the engine oil sump, for closing the valve. In a presently preferred embodiment, the hydraulic actuator comprises a self-contained cartridge assembly including an actuator piston with dampers for damping motion of the actuator piston, limiting the actuator stroke to assure soft seating of the actuator, and to avoid overshoot during the engine valve opening stroke and the engine valve return stroke. The electro-hydraulic valves are electrically controlled by the engine computer, which generates electrical signals carried to the electro-hydraulic valves. The engine computer typically senses conventional engine variables, and optimizes performance of the valve actuation and control system according to preestablished guidelines, with information being supplied to the engine computer by sensors. The engine computer controls all aspects of engine performance, interfaces with all of the peripheral sensors, and calculates fuel parameters, ignition timing and engine valve timing based upon prior mapping of the engine. In this manner the engine can be controlled so as to provide maximum fuel economy, minimum emissions, maximum engine torque, or a compromise between these parameters.

35 Claims, 13 Drawing Sheets

U.S. PATENT DOCUMENTS 2,232,502 2/1941 Wittman ..... 251/65
2,569,800 10/1951 Cataldo ..... 251/65
3,989,066 11/1976 Sturman et al. .
4,107,546 8/1978 Sturman et al. .
4,108,419 8/1978 Sturman et al. .
4,114,647 9/1978 Sturman et al. .
4,227,489 10/1980 Regamey ..... 122/457
4,232,707 11/1980 Sturman et al. .
4,270,573 6/1981 Sturman et al. .
4,409,638 10/1983 Sturman et al. .
4,501,290 2/1985 Sturman et al. .
4,516,600 5/1985 Sturman et al. .
4,541,454 9/1985 Sturman et al. .
4,544,986 10/1985 Büchl .
4,614,170 9/1986 Pischinger et al. .
4,782,426 11/1988 DeCamp et al. .
4,799,582 1/1989 Lequesne .
4,810,967 * 3/1989 Yokoyama et al. ..... 4/207.25
4,811,221 3/1989 Sturman et al. .
4,857,842 8/1989 Sturman et al. .
4,930,465 6/1990 Wakeman et al. ..... 123/90.12
4,955,348 9/1990 Budde et al. .
4,974,495 12/1990 Richeson, Jr. .
5,022,565 6/1991 Sturman et al. .
5,058,857 10/1991 Hudson .
5,162,710 11/1992 Reinhart et al. ..... 318/254
5,190,262 3/1993 Woollatt .
5,197,428 3/1993 Hornby .
5,222,714 6/1993 Morinigo et al. .
5,251,659 10/1993 Sturman et al. .
5,255,641 10/1993 Schechter .
5,287,829 2/1994 Rose .
5,301,875 4/1994 Gant et al. .
5,304,971 4/1994 Sturman et al. .
5,335,633 8/1994 Thien .
5,347,961 9/1994 Buehrle, II et al. .
5,395,012 3/1995 Grill et al. .
5,402,652 4/1995 Alsenz .
5,404,844 4/1995 Schechter .
5,407,131 4/1995 Maley et al. .
5,419,301 5/1995 Schechter .
5,419,492 5/1995 Gant et al. .
5,445,182 8/1995 Sturman et al. .
5,456,221 10/1995 Schecter ..... 123/90.12
5,456,222 10/1995 Schecter ..... 123/90.12
5,456,223 10/1995 Miller et al. ..... 123/90.12
5,460,329 10/1995 Sturman .
5,562,070 10/1996 Schecter et al. ..... 123/90.12
5,604,304 * 2/1997 Kokubo et al. ..... 73/117.3
5,613,473 * 3/1997 Angermaier ..... 123/481
5,638,781 6/1997 Sturman ..... 123/90.12
5,640,987 6/1997 Sturman .
5,690,064 11/1997 Izuo .
5,720,242 2/1998 Izuo .
5,730,091 3/1998 Diehl et al. .
5,826,551 * 10/1998 Vuuren ..... 123/90.12

INTERNAL COMBUSTION VALVE OPERATING MECHANISM

RELATED APPLICATIONS

This is a continuation of Ser. No. 09/092,445 filed Jun. 5, 1998, now U.S. Pat. No. 6,024,060.

BACKGROUND OF THE INVENTION

1. Field of the Invention

This invention relates generally to a valve actuating apparatus for engines, and more particularly concerns a system for actuating and controlling reciprocating valves for the cylinders of an internal combustion engine.

2. Description of Related Art

Conventional piston type internal combustion engines typically utilize mechanically driven camshafts for operation of intake and exhaust valves, with fixed valve lift and return timing and duration. Electrically or hydraulically controlled valves for improved control of valve operation have also been used in order to improve fuel economy and reduce exhaust emissions.

For example, a variable engine valve control system is known in which each of the reciprocating intake or exhaust valves is hydraulically controlled, and includes a piston receiving fluid pressure acting on surfaces at both ends of the piston. One end of the piston is connected to a source of high pressure hydraulic fluid, while the other end of the piston can be connected to a source of high pressure hydraulic fluid or a source of low pressure hydraulic fluid, under the control of a rotary hydraulic distributor coupled with solenoid valves.

Another engine valve actuating system is known in which each cylinder is provided with a coaxial venturi shaped duct having inwardly facing vanes that hold an electro-mechanical valve actuator. When the electro-mechanical valve actuator receives a pulsed electrical signal, the actuator operates to reciprocate the valve.

While a camshaft driven intake or exhaust valve will typically open and close with a constant period as measured in crankshaft degrees, for any given engine load or rpm, there is a need for an indirect valve actuation system for internal combustion engines that can operate more rapidly, and that will open the valve at the same rate regardless of engine operating conditions. Ideally, a valve actuation system should match the optimum, maximum valve rate of operation at maximum speed of operation of an engine to provide a rapid, optimum valve operation rate. It would also be desirable to provide a valve actuation system for internal combustion engines offering a speed of operation that will allow greater flexibility in programming valve events, resulting in improved low speed torque, lower emissions, and better fuel economy. Conventional approaches to providing higher rates of valve opening and closing have used non-latching control valves commonly involving systems using either spool valves or poppet valves, neither of which provide for a high flow open area in a small, low inertia system or energy efficient latching mechanisms. It would be desirable to provide a valve actuation and control system with an electro-hydraulic valve system, having a high flow open area, low inertia of operation, a small size, and case of manufacture. The present invention meets these needs.

SUMMARY OF THE INVENTION

Briefly, and in general terms, the present invention provides for an intake/exhaust (I/E) reciprocating valve actuation and control system for the cylinders of an internal combustion engine, comprising I/E poppet valves moveable between a first and second position; a source of pressurized hydraulic fluid; a hydraulic actuator including an actuator piston coupled to the poppet valve and reciprocating between a first and second position responsive to flow of the pressurized hydraulic fluid to the hydraulic actuator; an electrically operated hydraulic valve controlling flow of the pressurized hydraulic fluid to the hydraulic actuator; and electronic control means generating electrical pulses to control the electrically operated valve.

In one presently preferred embodiment, the invention provides for a three way electrically operated valve controlling flow of the pressurized hydraulic fluid to the actuator, supplying pressure when electrically pulsed to open, magnetically latching, and dumping actuator oil to an engine oil sump when the valve is electrically pulsed to close. The electrically operated valve preferably comprises a three path rotary latched magnetic motor actuating a rotary valve portion having a housing, a rotor, and a stator receiving and supplying hydraulic fluid pressure to the rotor, which alternately directs the hydraulic fluid pressure to the valve cylinder for opening of the valve, or to return to the engine oil sump, for closing the valve.

In a presently preferred embodiment, the hydraulic actuator comprises a self-contained cartridge assembly including an actuator piston with means for damping motion of the actuator piston, limiting the actuator stroke to assure soft seating of the I/E valve, and to avoid overshoot during the engine valve opening stroke and the engine valve return stroke. In a currently preferred embodiment, the source of pressurized hydraulic fluid comprises an engine-driven pump supplying engine oil under pressure as the hydraulic fluid, an accumulator is used to provide a reservoir of high pressure fluid, and an engine oil sump for receiving return hydraulic fluid. An unloader valve limiting pump output pressure is also provided, along with a check valve preventing backflow from the engine oil sump. An accumulator is also preferably provided for storing a sufficient volume of pressurized hydraulic fluid to moderate the pump and unloader valve duty cycle. The unloader valve preferably comprises a pressure sensing valve that senses pump output pressure and opens when the pressure reaches a preset value, so that when the unloader valve is open, flow from the pump returns to the engine oil sump. The accumulator is also used to store energy primarily dissipated under deceleration by the brakes or as a compression brake by filling the accumulator during that time. The engine would use the torque from the wheels in reverse driving the hydraulic pump and filling the accumulator, thus recycling velocity energy that would normally be lost to wheel braking.

Thus, the hydraulic pump could be temporarily disconnected so that under high load, the valve train would run off stored accumulator energy. This would use more of the power lost during braking. In a presently preferred embodiment, the control means comprises a computer, and sensors are operatively connected to the computer, for monitoring engine variables, and for optimizing performance of the system.

These and other aspects and advantages of the invention will become apparent from the following detailed description and the accompanying drawings, which illustrate by way of example the features of the invention.

DETAILED DESCRIPTION OF THE PREFERRED EMBODIMENTS

While mechanical camshafts for the intake and exhaust valves of internal combustion engines typically have a period of opening and closing that remains constant in terms of crankshaft degrees for any engine load or rpm, this has limited the ability of the automotive industry to improve fuel economy, reduce harmful exhaust emissions, and to improve low end torque. Typical approaches to providing variable valve opening and closing positions have involved either variable mechanical linkages or phasing by motors connecting the camshaft to the cam drive. These methods do not provide a high flow open area in a small low inertia system.

Figure 1:
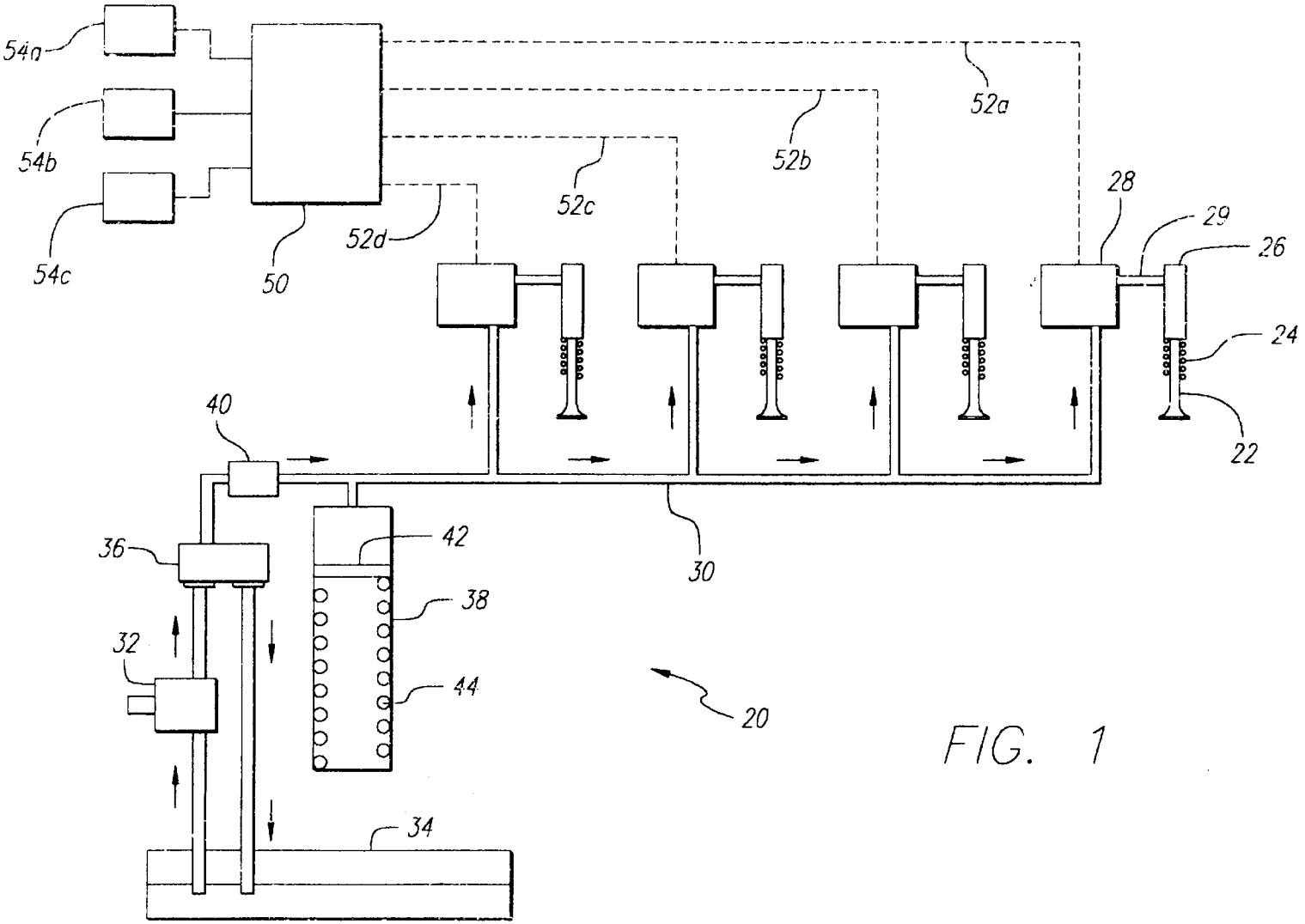
FIG. 1 is a schematic diagram of the internal combustion engine reciprocating valve actuation and control system of the invention.

The present invention accordingly provides for an improved reciprocating valve actuation and control system for the cylinders of an internal combustion engine. As is illustrated in the drawings, and as is generally shown in FIG. 1, the reciprocating valve actuation and control system of the invention is a camless valve control system 20 for an engine poppet valve 22 moveable between a first, open position, and a second, closed position in which the engine poppet valves are reseated by common valve springs 24. The engine poppet valves are driven by hydraulic actuators 26, which are controlled by electrically operated electro-hydraulic valves 28 supplying hydraulic fluid to the actuators via conduit 29. The hydraulic fluid is preferably engine oil, supplied to the electro-hydraulic valves by the pressure rail 30. An engine driven hydraulic pump 32 supplies the oil pressure that is used to open the engine poppet valves, receiving the oil from an engine oil sump 34. In a presently preferred embodiment, the electro-hydraulic valves are three way type hydraulic valves, supplying pressure when electrically pulsed to open, magnetically latching, and dumping the actuator oil to the sump when pulsed to close. Each engine I/E valve is preferably provided with an actuator and an electro-hydraulic valve.

In a presently preferred embodiment, the engine driven pump 32 is a hydraulic pump driven directly by the engine, so that the output of the pump will increase in direct proportion to the engine speed. The positive displacement pump is preferably sized to provide about 110% of the oil flow required by the engine system of valves. The engine oil return from the electro-hydraulic valve and piston actuator assembly is to the engine oil sump, typically by gravity through the normal engine drainage passage (not shown). The positive displacement pump output pressure is also preferably limited by an unloader valve 36, as moderated by an accumulator 38 connected to the oil pressure rail. The nature of the actuator and the valve utilizing the normal engine oil supply allows the engine oil supply to be used as a hydraulic fluid even if the engine oil supply contains some entrained air, drastically simplifying the system and accessories that would otherwise be required to condition the hydraulic fluid, and obviating the need for a separate hydraulic fluid supply.

The unloader valve 36 preferably comprises a pressure sensing valve that senses pump output pressure and opens when the pump output pressure reaches a preset threshold value. When the unloader valve is opened, all of the flow from the positive displacement pump is to return to the engine oil sump, so that the output from the pump is then "unloaded". A check valve 40 is also preferably provided in the fluid line between the accumulator and the unloader valve to prevent backflow from the accumulator.

The accumulator in the system is provided to receive oil from the pump, accepting a volume of engine oil from the pump as an accumulator piston 42 moves within in the accumulator to create the interior accumulator volume. A means for biasing the piston to maintain pressure on the piston is also provided, preferably in the form of a coil spring 44, although other means of biasing the piston to provide system oil pressure could also be used, such as a pneumatic pressure chamber, for example. When the unloader valve senses that pump output pressure has reached the preset threshold value, opening to allow flow from the pump to return to the engine oil sump, the hydraulic fluid flow and pressure are supplied to the system from the accumulator. When this supply is exhausted, the system pressure drops, the unloader valve senses the system pressure drop below a lower, preset minimum oil pressure threshold, and closes, allowing the pump to reload the accumulator volume. The cycling rate of this action depends on the settings of the minimum and maximum oil pressure thresholds of the unloader valve. The unloader valve settings can be relatively close together, so that the system cycles rapidly, or can be set relatively far apart, so that the cycle rate is slower, and resulting in a greater variation of hydraulic fluid supply pressure, as desired. Unloader valve settings can be controlled by the engine control unit (ECU), or engine computer 50.

The electro-hydraulic valves are preferably electrically controlled by the engine computer 50 (ECU), which generates electrical signals carried to the electro-hydraulic valves via electrical connectors 52*a–d*. The engine computer typically senses conventional engine variables, and optimizes performance of the valve actuation and control system according to preestablished guidelines, with information being supplied to the engine computer by sensors 54*a–c*. The valve actuation and control system typically includes a manifold pressure sensor, a manifold temperature sensor, a mass flow sensor, a coolant temperature sensor, a throttle position sensor, an exhaust gas sensor, a high resolution engine position encoder, a valve/ignition timing decoder controller, injection driver electronics, valve coil driver electronics, ignition coil driver electronics, air idle speed control driver electronics, power down control electronics, and a standard communications port. In addition to controlling the engine valves through the hydraulic actuation system, the engine computer also typically sequences engine ignition, fuel injection and OBD (onboard diagnostics).

The engine computer preferably utilizes a high performance digital signal processor (DSP), so that control of all aspects of the engines performance can be attained. The DSP interfaces with all of the peripheral sensors, and calculates fuel parameters, ignition timing and engine valve timing based upon prior mapping of the engine. Mapping is performed multi-dimensionally using engine speed, manifold pressure, induction mass flow and temperatures. In this manner the engine can be controlled so as to provide maximum fuel economy, minimum emissions, maximum engine torque, or a compromise between these parameters.

An alternate mapping method to simplify system complexity and reduce parts count would be induction mass flow, temperatures, barometric pressure, engine speed and pedal position sensors.

The engine computer will determine if the current operating conditions are within or not within the normal driving cycle of the engine, and will adjust the operation as is required. Configuration software is utilized that allows the reciprocating valve actuation and control system to be tailored for an exact engine system. Engines can be mapped on any engine dynamometer, and evaluated across engine speed and load, so that independent maps can be developed for fuel economy, emissions or torque. Maps are stored for ignition, fuel control and valve control and can be used separately or in combination.

The crankshaft position sensor is used to provide the engine control unit with a method of controlling engine valve/fuel injection/ignition events. The engine crank position sensor must be reliable, accurate, low cost and have a long life. The accuracy and repeatability should ideally be better than or equal to that of a conventional mechanical camshaft, and with a simple electrical interface to the engine control unit. Analog and digital rotational position sensors can meet these requirements.

Most analog position sensors can be eliminated if they have any contacting parts that wear out. Resolvers and sin/cosine (hall effect) potentiometers have output signals that must be phase decoded, digitized, and then require a table lookup to generate a digital angle output. These analog sensors usually suffer from long term drift or linearity/drive problems. A digital sensor eliminates these problems, and is available at low cost. Two types of position encoders are in wide use today: magnetic (hall effect), and optic (photoelectric).

Both of these position encoder types are generally available as absolute position encoders. In addition, an automotive sensor should also be inexpensive and readily mounted to an engine crankshaft. A typical engine crankshaft has up to +/−0.003 inch of axial end play, but good axial rotational concentricity. Absolute position encoders need to have precision end play and axial alignment and need to be mounted in a vibration and shock free environment to give accurate readouts.

A 360 count, sin/cosine optical encoder can meet all of the above requirements, because recent optical encoder array sensor developments allow the encoder to be mounted on the crankshaft and function well in an automotive environment. A magnetic encoder can also be used, but this presently requires a larger space, and presents somewhat greater difficulty to initially index the sensor on the crankshaft for proper synchronization of the engine in an automotive environment.

For either magnetic or optic encoders, the sin/cosine & index pulses must be converted into a shaft angle output to control valves, fuel injection, and ignition. It is also desirable for the position sensor to be able to operate in 2, 3, 4, 5, 6, 8, 10, 12 or 16 cylinder engines; therefore the sensor output counts must be divisible by 2, 3, or 5 to give the same timing to all cylinders (without odd offsets which cause vibration and uneven operation). This requirement eliminates a 256 or 512 count/rev encoder and their simple base 2 arithmetic. With a 360 count encoder, a resolution of ¼ degree and accuracy of about ⅓ degree is obtained from the quadrature output decoding of the sin/cosine signals (and the count is divisible by 2, 3, or 5).

The engine computer must make valve timing/fuel injection and ignition timing computations (or lookup tables) that ensure engine horsepower/RPM/torque requirements and clean combustion for the engine. Since the engine computer is busy checking many other sensors that ensure clean combustion and efficient operation, it is desirable to "unload" the engine computer by controlling valve timing, fuel injection, and ignition timing with fixed hardware circuits. This unloading also will allow a smaller and lower cost microprocessor to be used in the engine control unit.

It is desirable to allow the engine computer to give valve timing and ignition or fuel injection updates to the valve control circuits at any time during the engine rotation without risk of damage to valve or piston position. This becomes more apparent in 8 to 12 cylinder engines, since more events occur during the same engine revolution and at different times than in 4 or 6 cylinder engines. An update to any engine parameter is effective during the current and subsequent control events until the next update occurs. Thus, the engine computer will not delay updates until a "safe" point in the cycle is reached to update timing events. Especially if a cylinder misfires, it is necessary to change something immediately if gross pollution is to be avoided, and the engine computer may shut that cylinder off if necessary.

Engine starting and stopping are a problem using a sin/cosine encoder. During start (power application), the engine sensor does not determine its absolute position until the first index pulse is received. Further, at engine shutoff, power will be removed that prevents further valve control, so all valves must be quickly closed (for further uncontrolled engine rotations). These shutdowns can be easily handled by the sensor and/or the engine control unit. During a controlled shutdown (ignition switch turned off), valves and engine ignition can be fully controlled until zero rotation by the engine computer, sequentially shutting off fuel, then closing intake valves, then closing exhaust valves, then turning off power to itself and engine position sensor. This can be handled with minimum pollution, if desired, or any other requirement.

In case of other, sudden, unexpected power failures, the engine computer will shut valves (uncontrolled) with a power fault detect circuit and local power hold up capacitor. This will prevent engine damage, and contain most pollutants within the engine.

During power application (and engine cranking), the engine position sensor immediately loads default starting values for all valve/ignition/fuel injection settings. When engine cranking begins, the engine position sensor will command all valves to close (in case any are open). The engine position sensor will not command and output events until the first sine/cosine index pulse is received (so absolute crank position is known). The vehicle driver may have to crank the engine up to one full revolution before this occurs (with all valves closed), but this will assure adequate hydraulic pressure for a good clean start. The engine computer may update default engine starting values at any time after power application.

The engine position sensor must also be able to handle reverse engine rotation (safely) if the engine accidently rotates backwards, (if parked on a hill or during a misfire at startup). These conditions occur only occasionally, but in all cases, valves must be closed when the piston is at or near top dead center (TDC) to prevent engine damage. This is performed as a result of standard quadrature decoding.

The valve actuation and fuel control system software is a fully interrupt driven control system that is centered around a DSP processor as a real time engine controller. The valve actuation and interrupt system software is written in the DSP processor's native instruction set for speed and efficiency. The other engine sensors operate independently from the processor, and their routines can be written in a higher language such as BASIC or $C^{++}$, for example.

The valve actuation and fuel control system can operate both synchronously as well as asynchronously with respect to engine rotation intervals. The major operating tasks such as data acquisition and digital filtration are performed asynchronously in constant time intervals, but the calculation of some engine parameters, particularly fuel injection and valve angles, are calculated during degree based intervals.

The valve actuation and fuel control system contains a real-time monitor that allows another software package to query the valve actuation and control system for "while running" information. This feature allows dynamic data updates to be done by another host computer system for emissions, diagnostic and custom tuning work.

The valve actuation and fuel control system interfaces to the engine position decoder via an 8 or 16 bit word. This interface sets individual registers within the decoder, that define starting and stopping points for events in degrees. The degree based events controlled by the valve actuation and engine control system is ignition dwell, engine valve open position and engine valve closed position of all intake and exhaust valves as well as the start of the fuel injection event. In addition, the start of the fuel injection event is timed such that the end of injection event will occur approximately simultaneous with the spark instant. Because the engine ignition is degree based, the degrees that the ignition coil are held powered is its dwell, and can be held either at a constant dwell or at a constant coil energy. The latter is the most desirable for lower power consumption and cooler ignition coil operation.

The propagation delay of the engine valves must be taken into account for top performance. This can be accomplished as part of valve/ignition/fuel injection mapping, but as the system ages, and some valve velocity may be lost, the valve actuation and control system can measure its own average valve velocity and recommend a tuneup.

The valve actuation and fuel control system controls the fuel by setting the individual injector time periods proportional to the amount of fuel calculated by the engine computer. The start of each injector pulse can be set at any crank angle and can run for times up to 720 crank degrees. The valve actuation and fuel control system can run the injectors in true sequential or phased sequential patterns for better atomization. This system could also operate a direct injected gasoline engine.

With reference to FIGS. 2–7C, the hydraulic valve actuators of the reciprocating valve actuation and control system are preferably provided as self-contained cartridge assemblies. The hydraulic actuators preferably include an actuator piston 60 coupled to the poppet valve, and reciprocating between a first, open position and a second, closed position, in response to flow of the pressurized hydraulic fluid to the hydraulic actuator. The actuator pistons are preferably sized to efficiently move the engine valves against their return spring forces. This sizing is typically determined by a computer design program that takes into account all of the necessary mechanical and hydraulic variables. An ideal piston size is generally one that distributes half of the pressure drop to the electro-hydraulic valve, and the other half of the pressure drop to the piston area for actuation. As will be explained further below, the actuator strokes are preferably terminated with hydraulic dampers to assure soft seating of the engine valves.

Figure 2:
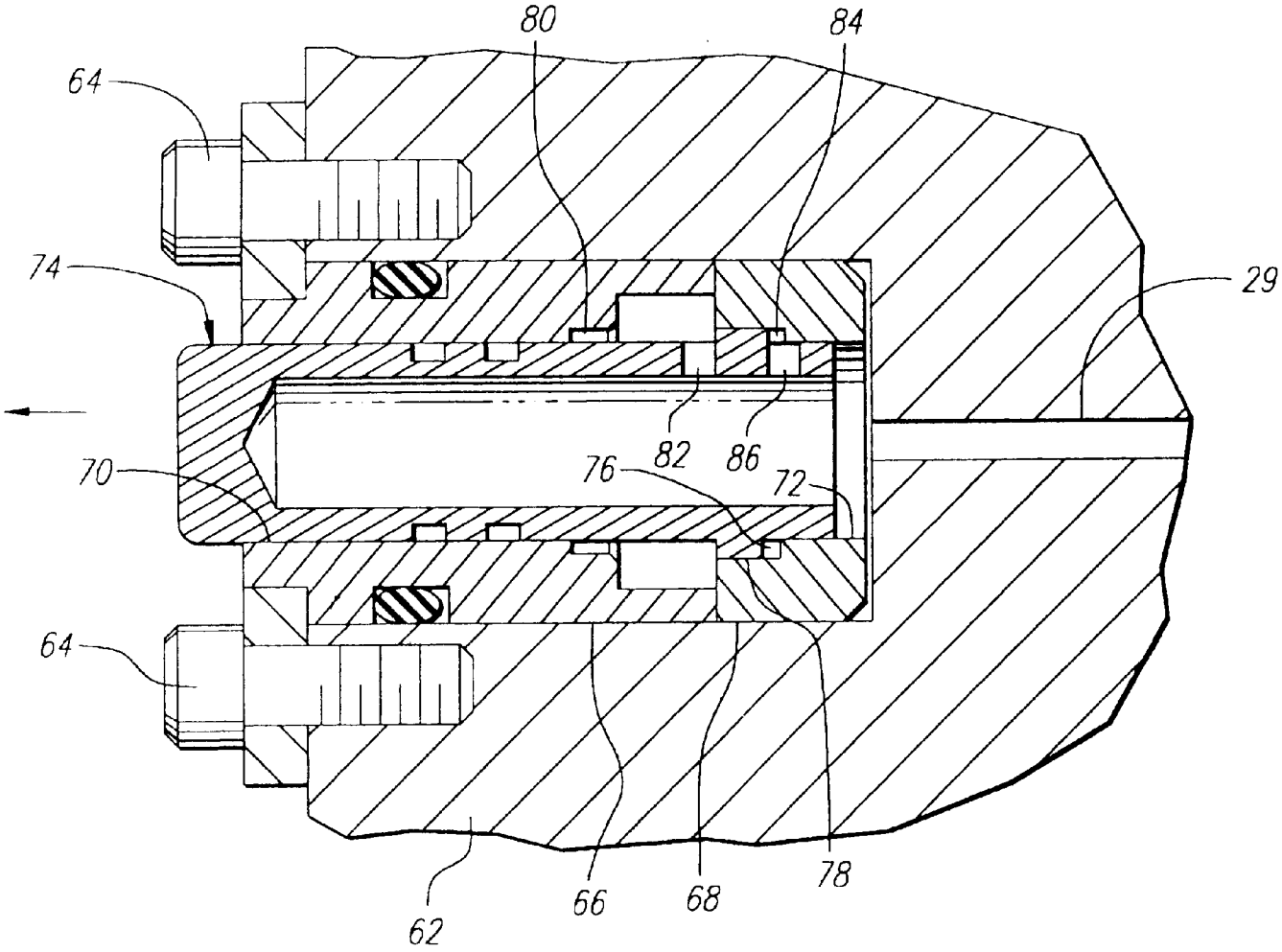
FIG. 2 is a sectional view of a first embodiment of a hydraulic actuator of the reciprocating valve actuation and control system of FIG. 1.

As is illustrated in FIG. 2, in one preferred embodiment of the hydraulic actuator of the reciprocating valve actuation and control system of the invention, the actuator piston 60 is mounted to the engine 62 by bolts 64. The hydraulic actuator assemblies include a main sleeve 66 and a secondary sleeve 68, and the actuator piston is disposed within the bore 70 of the main sleeve and the bore 72 of the secondary sleeve. Each of the main and secondary sleeves have precision lapped bores that mate with the outside diameter 74 of the actuating piston. In addition, each sleeve contains secondary bores 76 that fit closely with a damper land 78 of the actuator piston. The bores and the piston diameters are all concentric, typically with very close tolerances on the order of plus or minus 0.00005 inch (0.00125 mm). The hydraulic actuator piston preferably includes a hydraulic damper system for limiting the actuator piston stroke to assure soft seating of the actuator piston, and to avoid overshoot during the engine valve opening stroke and the return stroke. The secondary bore 76 of the main sleeve therefore defines a damping cavity 80, and the actuator piston includes a damping orifice 82 to decelerate the moving parts to avoid overshoot during the engine valve opening stroke. The secondary bore also preferably defines a damping cavity 84, and the actuator piston includes a damping orifice 86 to decelerate the system to avoid high impact of the engine valve into the valve seat on the return stroke. The stepped land 78 enters these secondary diameters in the damping cavities at the ends of the opening and closing strokes, and the oil trapped in the respective cavities exits through the respective orifices, thus creating a controlled high back pressure, slowing down the motion of the piston and bringing the moving parts of the valve to a soft landing. Conventional engine valve return springs are used as a return device, so that energy stored in the spring drives the closing stroke, and so that energy for the closing stroke does not need to be supplied by the pumping system.

Figure 4:
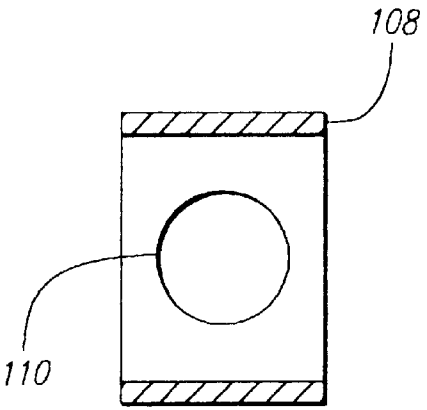
FIG. 4 is a sectional view of a damping spacer of the hydraulic actuator of FIG. 3.
Figure 3:
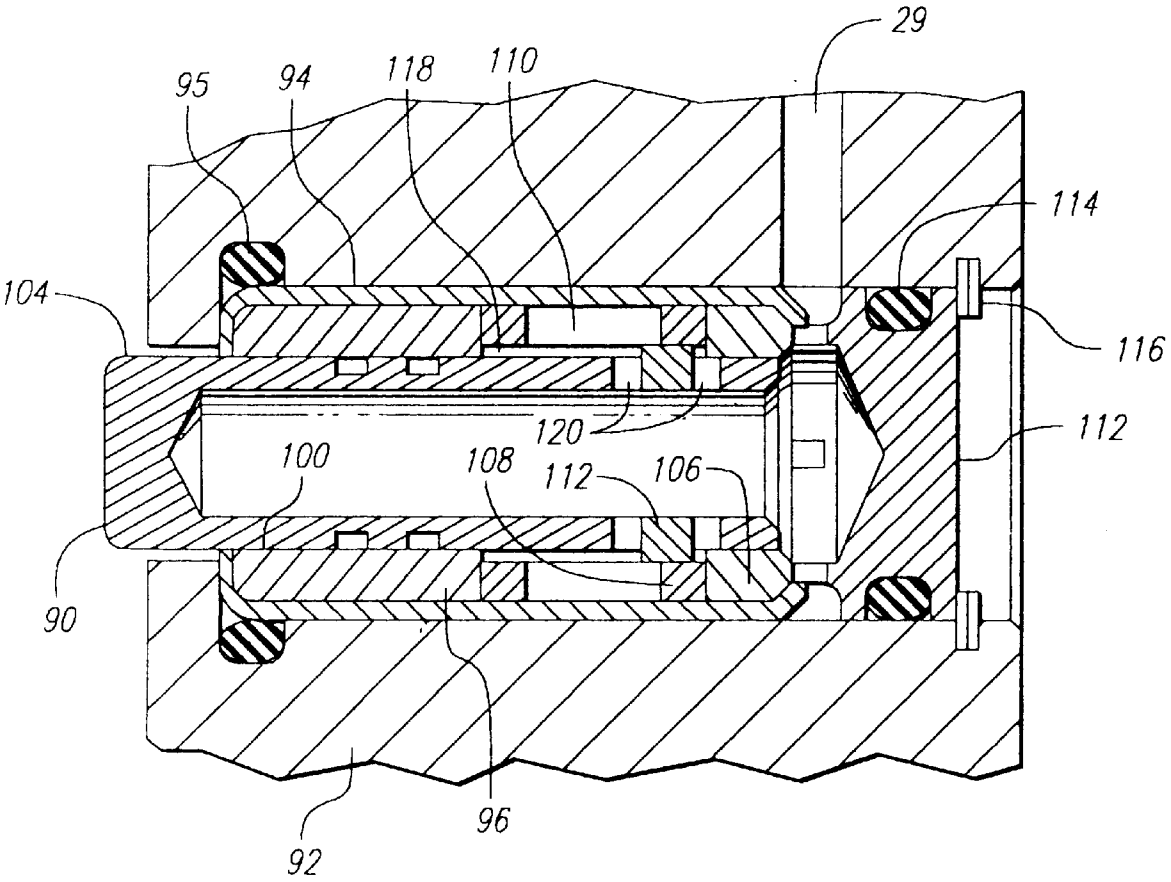
FIG. 3 is a sectional view of a second embodiment of a hydraulic actuator of the reciprocating valve actuation and control system of FIG. 1.

As is illustrated in FIGS. 3 and 4, in a second embodiment, the actuator piston 90 is mounted in the engine 92 within an alignment tube 94, sealed within the engine by the o-ring 95. The actuator piston cartridge assembly includes a main sleeve 96 disposed within the alignment tube and having a bore 100 mated to the outside diameter 104 of the actuator piston. The secondary sleeve of the piston assembly of FIG. 2 is replaced in this embodiment by the damping ring 106 disposed within the alignment tube, and a damping spacer 108. The damping spacer is preferably drilled to provide a gap 110, and is disposed within the alignment tube between the main sleeve and the damping ring. The actuator piston assembly is preferably contained either as a shrink fit or a pressed fit in the alignment tube. The inside diameter of the main sleeve can easily be formed to be matched to the outer diameter of the actuating piston, while the outside diameter of the actuating piston can be sized while on a mandrel that is concentric to the inner bore of the sleeve. These considerations allow the manufacturing cost of the actuator piston and the main sleeve to be relatively inexpensive. Similarly, the damping ring 106 is preferably configured as a bushing, and can easily be manufactured to close tolerances and perfect concentricity. The damping spacer is also preferably manufactured as a bushing, and the gap provided by 110 provides limits for the undamped portion of the stroke of the actuating piston. The orifices 120 provide the damping. The inside diameter of the damping spacer must fit closely to the damping land 112 on the actuator piston, and the outside diameter is preferably concentric and sized as an interference fit with the alignment tube. However, concentricity and sizing for these close tolerance fits are easily obtained at low manufacturing costs with modem machining. The alignment tube is preferably manufactured from precision tubing, and is preferably made from a seamless tube that is either honed or roller swaged to size to fit the surrounding bushing parts. The main sleeve, the damping spacer, the damping rings and the actuating piston are preferably preassembled, and are preferably either press fit or shrink fit into the alignment tube. Once in place and checked for free action, the ends of the alignment tube are typically roller swaged or electron beam spot welded to permanently lock the parts in place. The resulting assembly can then be handled as a cartridge, and mounted in the engine with a sealing plug 115, o-ring 114, and a snap ring 116. A damping cavity 118 is provided between the outside diameter of the actuator piston and the inside diameter of the damping spacer 108, and damping orifices 120 are provided on either side of the damping land 112 of the actuator piston.

Figure 5B:
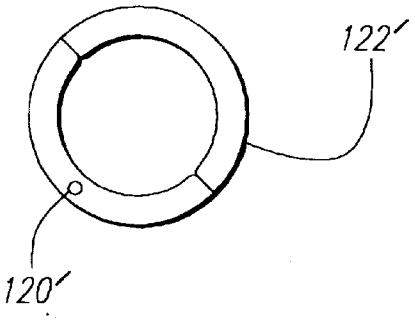
FIG. 5B is a plan view of the split ring of the hydraulic actuator of FIG. 5A.
Figure 5A:
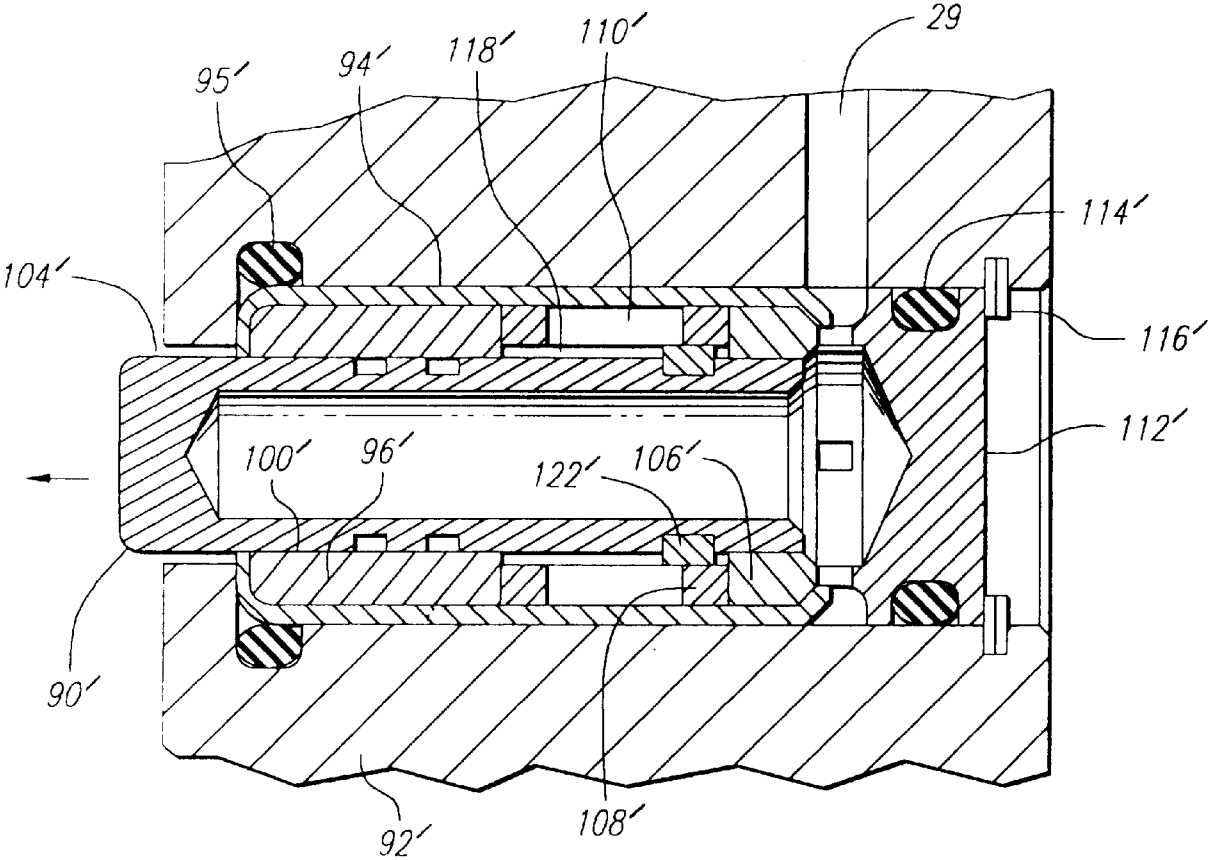
FIG. 5A is a sectional view of a third embodiment of a hydraulic actuator of the reciprocating valve actuation and control system of FIG. 1.
Figure 6:
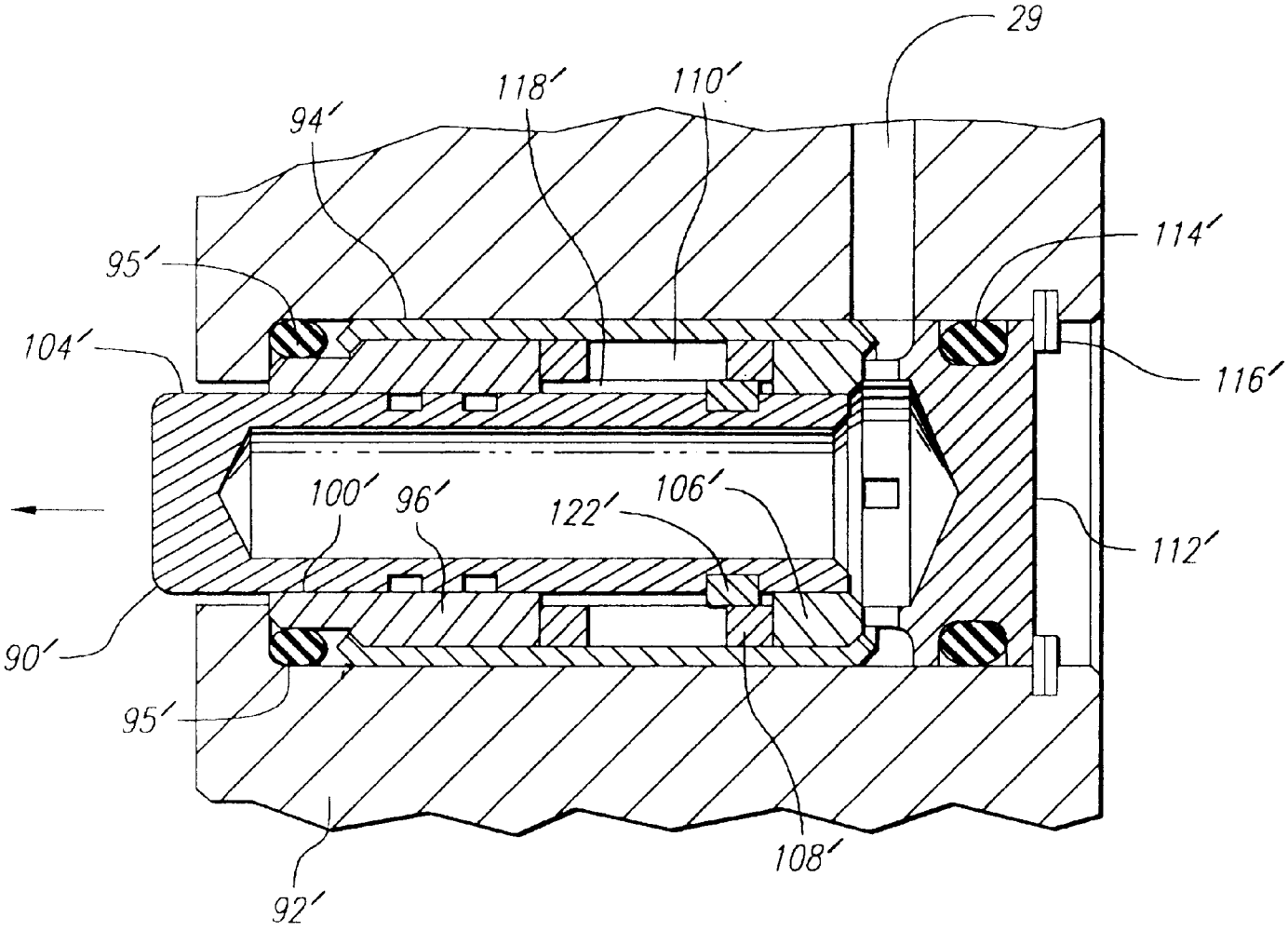
FIG. 6 is a sectional view of a fourth embodiment of a hydraulic actuator of the reciprocating valve actuation and control system of FIG. 1.

Referring to FIGS. 5A, 5B, and 6, in another embodiment, the actuator piston 90' has been modified to replace the stepped actuating piston land shown in FIG. 3, in order to reduce manufacturing costs of the actuating piston, by allowing the actuator piston to be manufactured as a cylindrical ground or lapped part. The actuator piston 90' is mounted in the engine 92' within an alignment tube 94' , sealed within the engine by the o-ring 95'. The actuator piston cartridge assembly includes a main sleeve 96' disposed within the alignment tube and having a bore 100' mated to the outside diameter 104' of the actuator piston. The damping ring 106' is disposed within the alignment tube, and a damping spacer 108' that is preferably drilled to provide a gap 110' is disposed within the alignment tube between the main sleeve and the damping ring. The actuator piston assembly is preferably contained either as a shrink fit or a pressed fit in the alignment tube. The inside diameter of the damping spacer must fit closely to the damping land 112' on the actuator piston, and the outside diameter is preferably concentric and sized as an interference fit with the alignment tube. The alignment tube is preferably manufactured from precision tubing, and is preferably made from a seamless tube that is either honed or roller swaged to size to fit the surrounding bushing parts. The main sleeve, the damping spacer, the damping rings and the actuating piston are preferably preassembled, and are preferably either press fit or shrink fit into the alignment tube. Once in place and checked for free action, the ends of the alignment tube are typically roller swaged or electron beam spot welded to permanently lock the parts in place. The resulting assembly can then be handled as a cartridge, and mounted in the engine with a sealing plug 115', o-ring 114', and a snap ring 116'. A damping cavity 118' is provided between the outside diameter of the actuator piston and the inside diameter of the damping spacer 108', and a damping orifice 120' is provided through the side of the damping land 122' of the actuator piston.

As is shown in FIGS. 5A and 6, the stepped land of the actuator piston can be replaced by a hardened split ring 122', and the actuating piston can be machined with a groove to accept this ring. Since the outside diameter of the actuating piston is a straight cylinder, the actuator piston can be centerless ground, roller lapped, or otherwise machined as a straight rod. The hardened split ring is a low cost part that has a closely sized outside diameter to fit closely to the damping spacer 108'. The inside diameter of the ring is not critical, and can be fit with a high clearance to the actuating piston groove. The hardened ring is typically machined, notched, heat treated, finished to size, and then is slipped onto a tapered mandrel and split at the notches. The two parts are kept as a pair and assembled to the actuating piston during assembly with the alignment tube. One or more damping orifices 120', such as a multiplicity of holes, slots, flats, and the like, are preferably formed in the ring, although only a single orifice is shown in FIG. 5B.

Figures 7A, 7B, 7C:
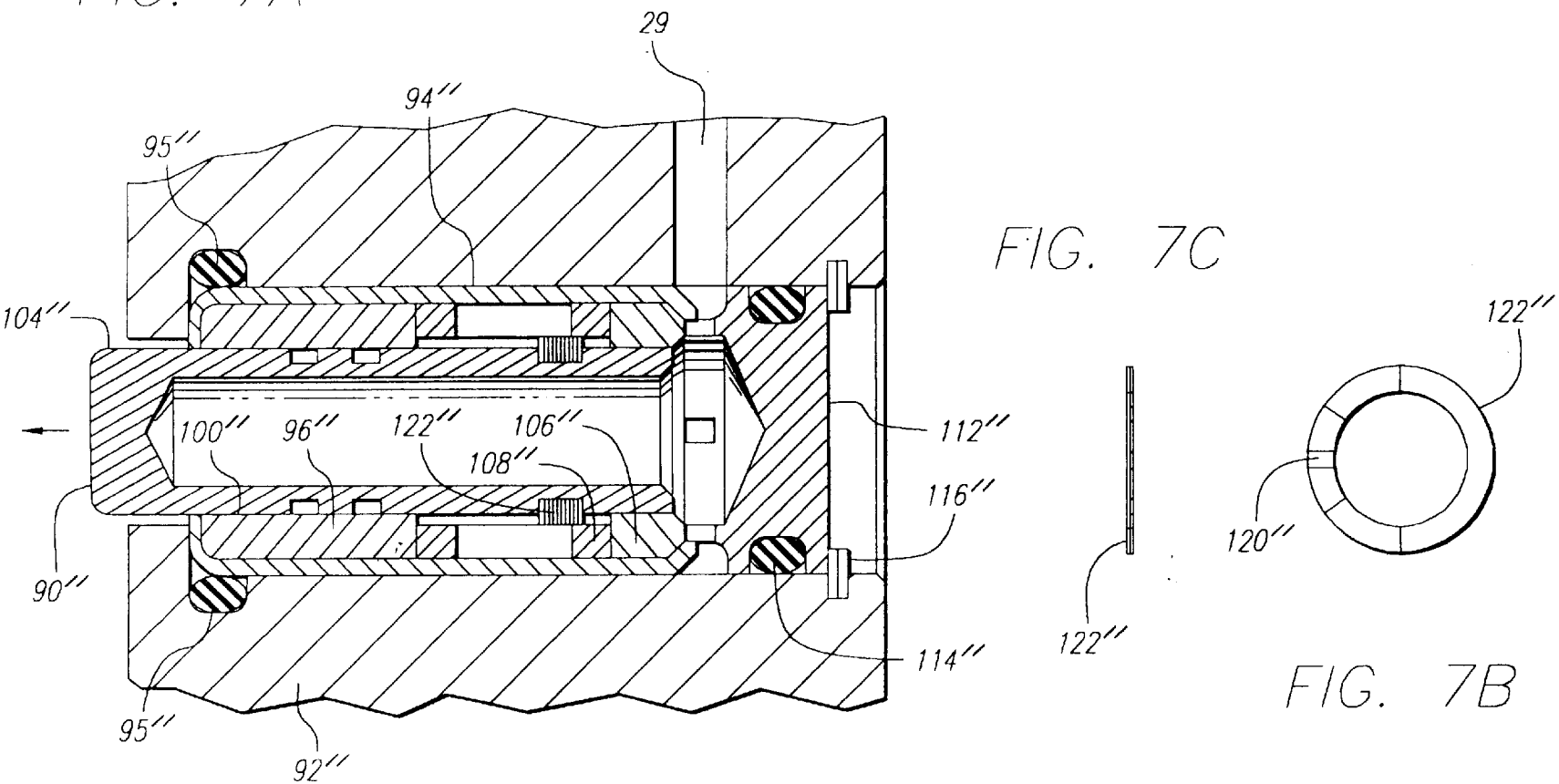
FIG. 7A is a sectional view of a fifth embodiment of a hydraulic actuator of the reciprocating valve actuation and control system of FIG. 1.
FIG. 7B is a plan view of the laminar sealing ring of the hydraulic actuator of FIG. 7A.
FIG. 7C is a side elevational view of the laminar sealing ring of FIG. 7B.
Figure 9:
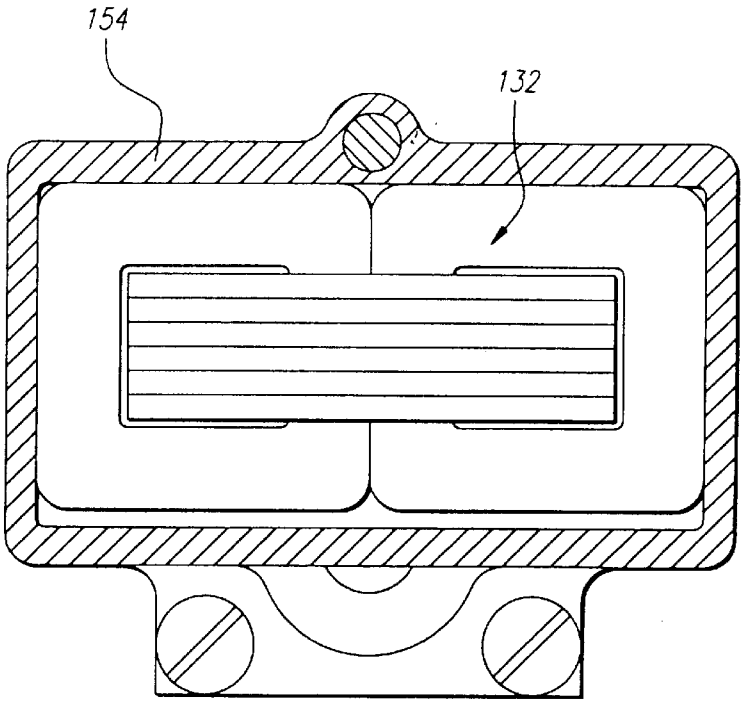
FIG. 9 is a cross-sectional view of the electrically operated valve motor taken along line 9—9 of FIG. 8.
Figure 8:
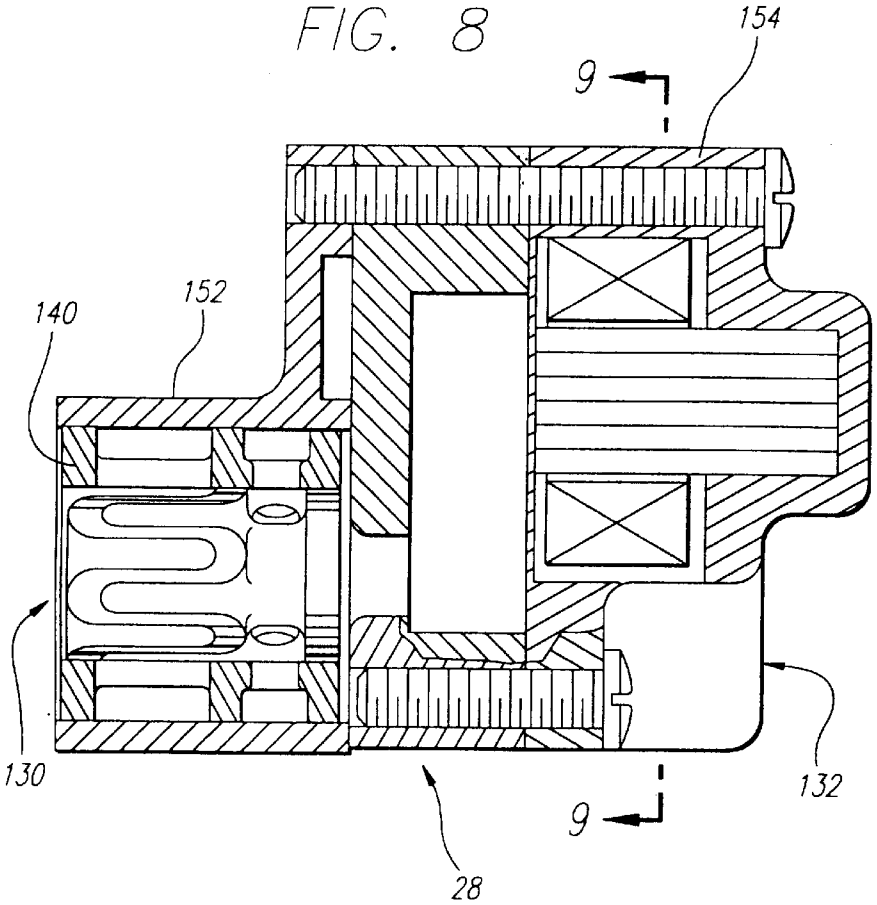
FIG. 8 is a sectional view of the electrically operated valve controlling flow of the pressurized hydraulic fluid to the actuator of the reciprocating valve actuation and control system of FIG. 1.
Figure 10:
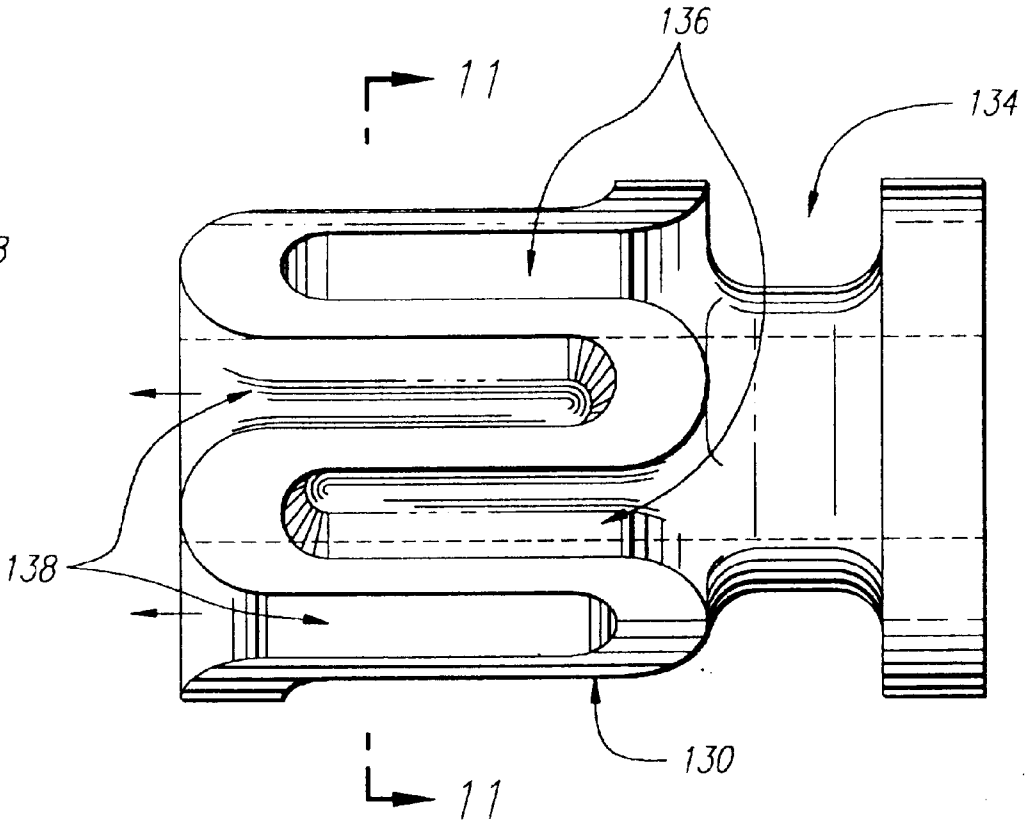
FIG. 10 is a plan view of the rotor of the rotary valve of the electrically operated valve of FIG. 8.
Figure 11:
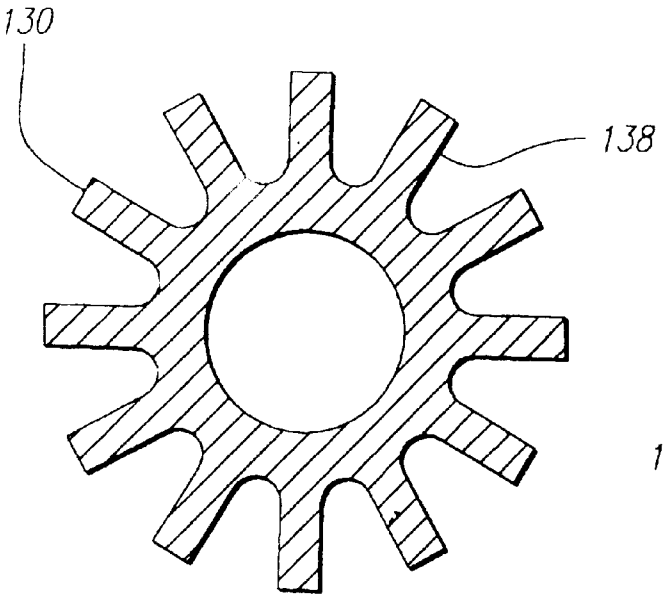
FIG. 11 is a sectional view of the rotor taken along line 11—11 of FIG. 10.
Figure 12:
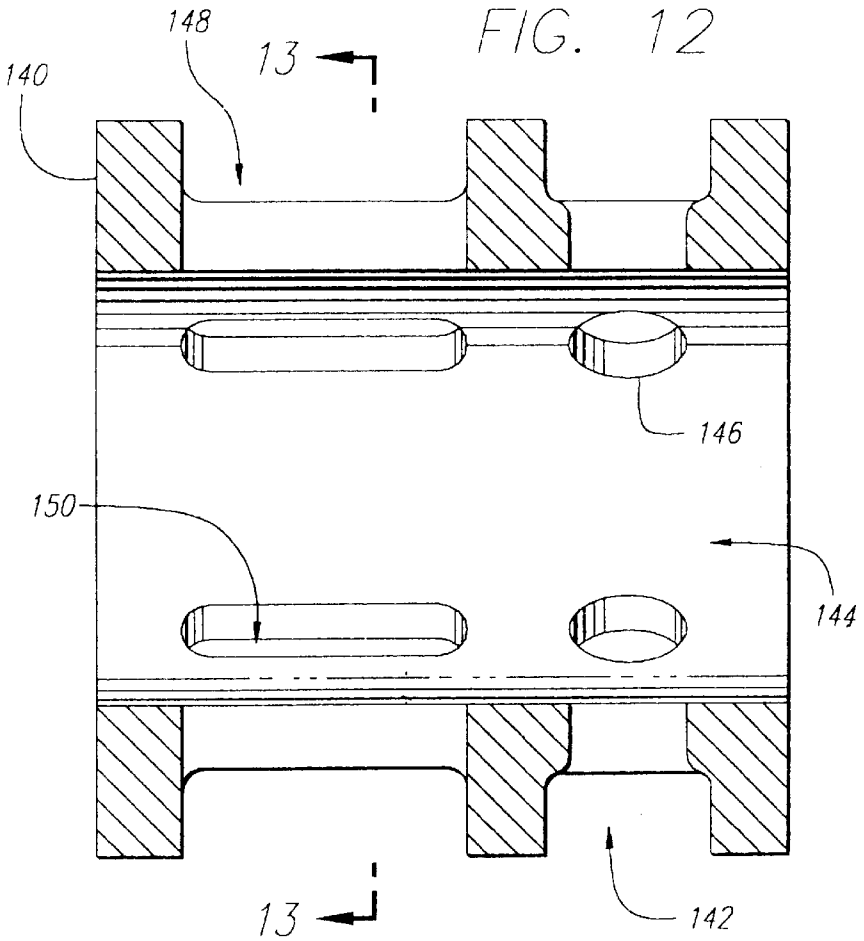
FIG. 12 is a sectional view of the stator of the rotary valve of the electrically operated valve of FIG. 8.
Figure 13:
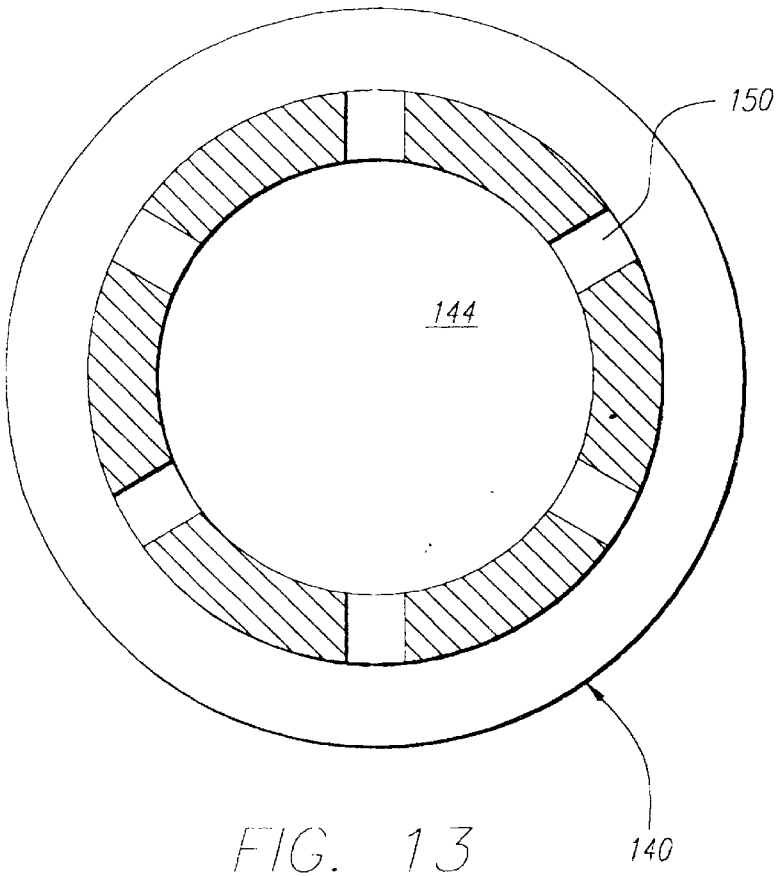
FIG. 13 is a cross-section of the stator taken along line 13—13 of FIG. 12.

As is illustrated in FIGS. 7A, 7B, and 7C, in another embodiment, the actuator piston 90" is assembled in the actuator piston cartridge assembly with an alternative type of replacement of the damping land of the actuator piston of FIGS. 2 and 3. The actuator piston 90" is mounted in the engine 92" within an alignment tube 94", sealed within the engine by the o-ring 95". The actuator piston cartridge assembly includes a main sleeve 96" disposed within the alignment tube and having a bore 100" mated to the outside diameter 104" of the actuator piston. The damping ring 106" is disposed within the alignment tube, and a damping spacer 108" that is preferably drilled to provide an orifice 110" is disposed within the alignment tube between the main sleeve and the damping ring. The actuator piston assembly is preferably contained either as a shrink fit or a press fit in the alignment tube. The inside diameter of the damping spacer must fit closely to the damping land 112" on the actuator piston, and the outside diameter is preferably concentric and sized as an interference fit with the alignment tube. The alignment tube is preferably manufactured from precision tubing, and is preferably made from a seamless tube that is either honed or roller swaged to size to fit the surrounding bushing parts. The main sleeve, the damping spacer, the damping rings and the actuating piston are preferably preassembled, and are preferably either press fit or shrink fit into the alignment tube. Once in place and checked for free action, the ends of the alignment tube are typically roller swaged or electron beam spot welded to permanently lock the parts in place. The resulting assembly can then be handled as a cartridge, and mounted in the engine with a sealing plug 115", o-ring 114", and a snap ring 116". A damping cavity 118' is provided between the outside diameter of the actuator piston and the inside diameter of the damping spacer 108", and damping orifices 120" are provided on either side of the damping land 112" of the actuator piston.

In this embodiment, the actuator piston damping land is replaced by a sealing ring, such as a two turn laminar sealing ring, such as a Smalley laminar sealing ring. Such a ring is generally available from manufacturers of spiral snap rings at a relatively low cost. Either one, two or three of these rings typically can be assembled into the actuating piston groove. The radial spring action of the ring keeps the rings in contact with the damping spacer 108", thus assuring low hydraulic fluid leakage. Small holes can also be drilled through these rings to act as one or more damping orifices 120", one of which is shown in FIG. 7B. Alternatively, the damping orifices in the actuator piston of FIG. 2 can be used. An advantage of using the laminar sealing rings is that the bore in the damping spacer can have a much relaxed tolerance, and all that is necessary is that a reasonably smooth surface be provided.

With reference to FIGS. 8–15, the electrically operated electro-hydraulic valves are generally of a rotary design. The electro-hydraulic valves 28 provide multiple paths for flow of the hydraulic fluid, such that the sum of the open areas in the valve is large, and relatively small rotational angles switch the cylinder ports from a pressure supply configuration to a return path configuration. Referring to FIGS. 8–11, the electrically operated electro-hydraulic valves preferably include a rotor or rotary valve element 130, assembled in combination with a three path latched magnetic motor 132. The rotor is provided with a pressure supply groove 134 that communicates with a plurality of axial pressure grooves 136 that branch from the pressure supply groove 134 and dead-end. A second set of axial return grooves 138 is also provided in the rotor, communicating at the opposing end of the rotor with the return to the system via the engine oil sump, and are dead-ended at their ends adjacent to the pressure supply groove. The rotor is preferably manufactured of high strength, hardened steel or an equivalent durable material. The outside diameter of the rotor is typically machined to a high finish and is precision sized to fit within the stator, or fixed valve element 140.

With reference to FIGS. 8 and 12–15, the stator is preferably provided with an inlet pressure port and an inner bore 144, with which the inlet pressure port is in fluid communication through a plurality of radially oriented holes 146. The stator also includes a cylinder port groove 148 in fluid communication with the inner bore and the axial grooves 136 and 138 of the rotor through a plurality of axial stator slots 150. The stator is also preferably fabricated of high strength, hardened steel or an equivalent durable material, and the inside diameter is also typically machined to a high finish and precision sized to mate with the rotor. The stator is installed in a housing 152 that provides the necessary fluid connections with the pressure supply and pressure return lines of the hydraulic fluid system, and the rotary valve housing 152 is assembled together with the housing 154 of the magnetic motor assembly.

Figure 14:
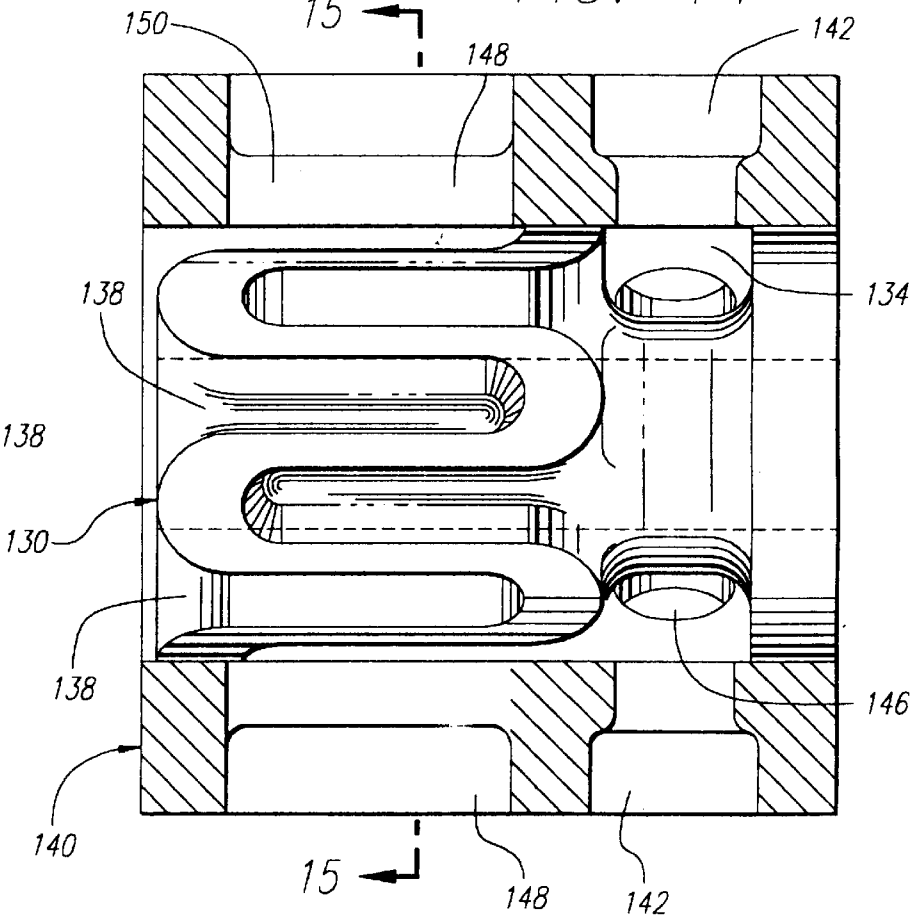
FIG. 14 is a sectional view of the rotary valve assembly of the electrically operated valve of FIG. 8.
Figure 15:
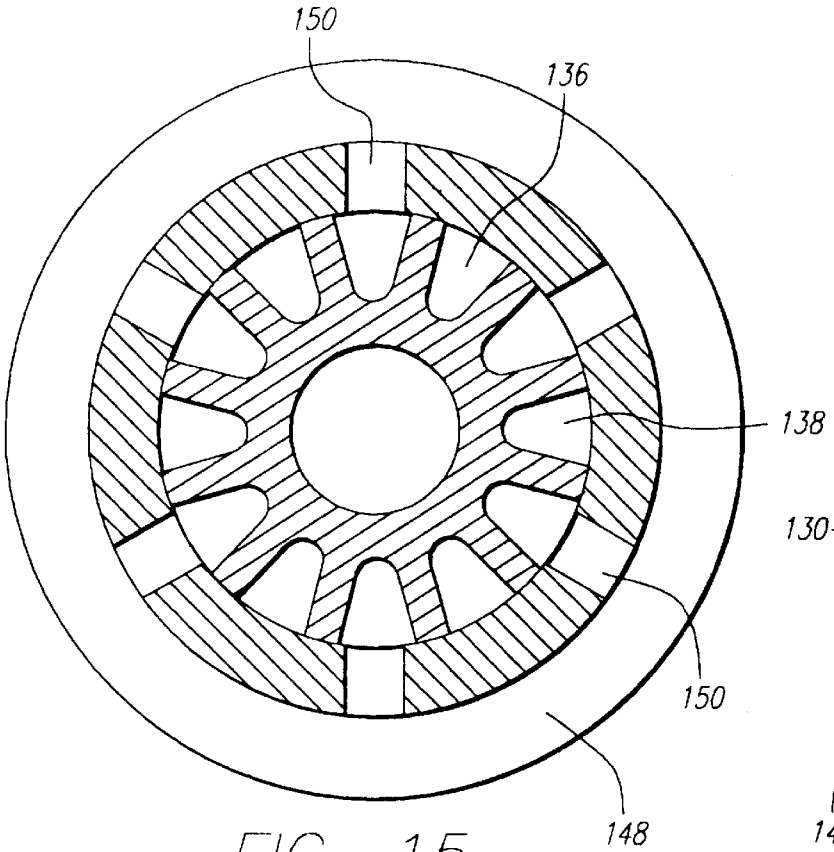
FIG. 15 is a cross-sectional view of the rotary valve assembly taken along line 15—15 of FIG. 14.

FIGS. 14 and 15 show the rotor and stator mated for operation, with FIG. 15 illustrating how the pressure will be distributed, in the valve cross-section. As can be readily appreciated, alternate grooves of the rotor will be either pressurized with the supply of pressurized hydraulic fluid, or will be at return pressure, depending upon the orientation of the rotor within the stator. The cylinder ports 150 are vented to the return grooves 138, and when the rotor is turned, preferably 9% clockwise, the cylinder ports will be connected to the pressure grooves 136. A hydraulic actuator connected to the cylinder port will then receive flow from six pressure grooves.

The open flow area of the valve depends upon the axial length of the cylinder port slots, and the diameter of the rotor-stator interface. The electrically driven magnetic motor assembly, connected to the rotor, can thus on command rotate the rotor first clockwise, and then counterclockwise, 9%. Other angles of rotation may, of course, also be suitable. It should thus be apparent that the rotary valve can open a very high flow area when rotated through relatively small angles. If additional area is required, the rotor and stator can be designed with increased length and the stator provided with longer cylinder port slots, as desired. In this manner, the valve design can be adapted to a variety of applications. The rotor design also inherently provides a very small rotational mass moment of inertia, since the numerous grooves on the outside diameter of the rotor have removed a substantial amount of material mass that would otherwise contribute to rotational inertia of the rotor. The small rotational angle required for operation of the rotary valve, and the low mass moment of inertia of the rotary valve both optimize the operation of the reciprocating valve actuation and control system of the invention for operation at very high cyclic rates, with a low power consumption by the electrical actuator.

The rotation of the cylindrical rotor element also entails very low friction, since the radial loading on the rotor is pressure balanced at all times, so that wear on the rotor and stator of the rotary valve will be minimized. It should be readily appreciated that the rotary valve design could easily be modified to provide a return passage similar to that used for the inlet pressure port, and an elongated version could also include a secondary group of cylinder ports to create a four way valve. It should also be readily appreciated that the rotor and stator are ideally configured for manufacture by investment casting or metal injection molding methods, which will permit greater economy in the manufacturing process.

Referring to FIGS. 8, 9, 16 and 17, the electrically operated electrohydraulic valves preferably are provided with a rotating motor driver capable of fast response to electrical pulses, with magnetic latching at two positions. Briefly, the magnetic motor consists of a three path magnetic circuit, with each of the three paths meeting at a central point. Two of the magnetic paths pass through individual magnetizing coils, while the third path includes a rotor and a stationary permanent magnet that holds or latches the rotary element in the position last commanded by the engine computer.

Figure 16:
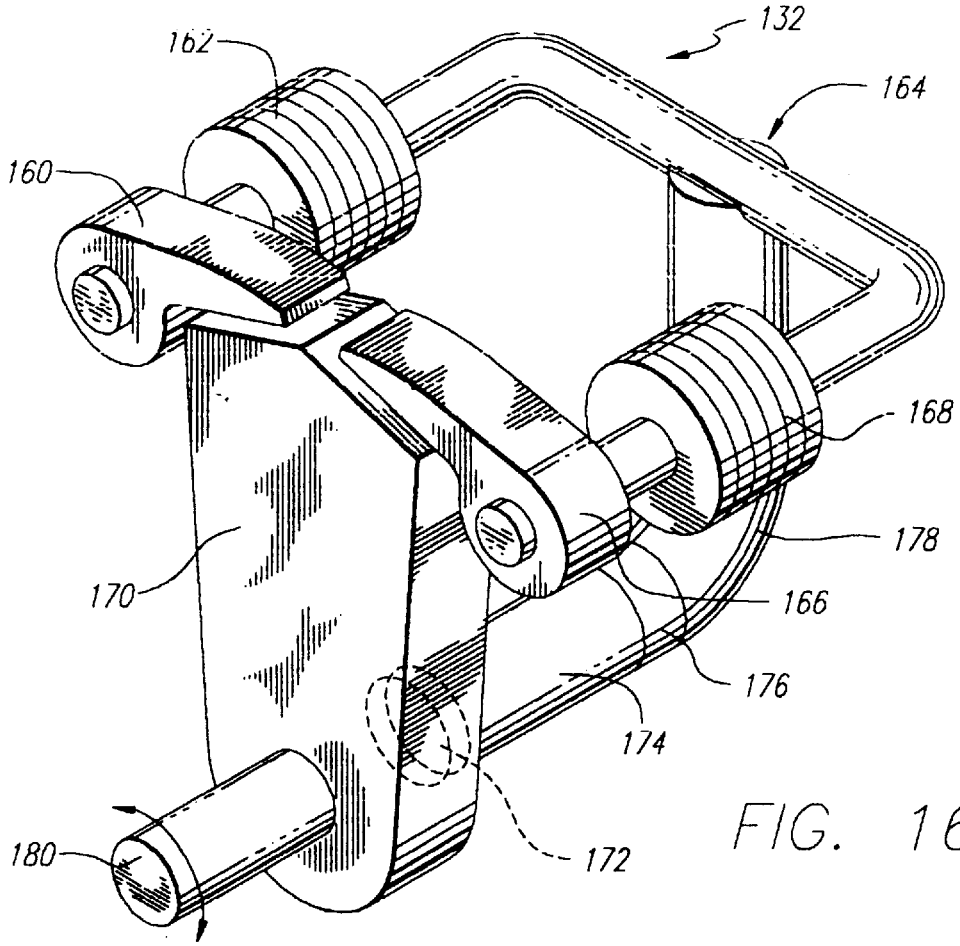
FIG. 16 is a perspective view of the rotary latched magnetic motor of the electrically operated valve of FIG. 8.
Figure 17:
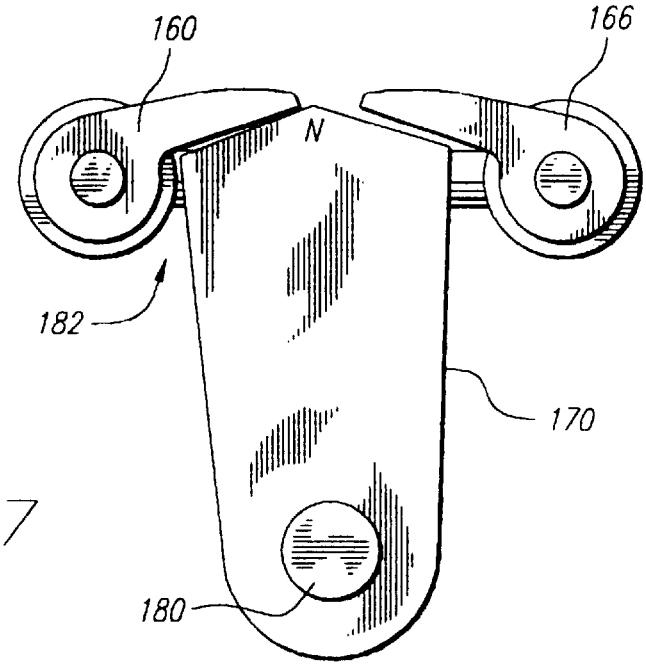
FIG. 17 is a schematic front view of the rotary latched magnetic motor of FIG. 16, illustrating operation of the motor.

As is best seen in FIG. 16, the first path of the magnetic motor is comprised of a first pole piece 160, connected to a first electromagnetic coil 162 energized by the electrical signals from the engine computer, and the magnetic junction 164 connected to the first pole piece and first coil. The second path of the magnetic motor similarly is comprised of a second pole piece 166 connected to a second electromagnetic coil 168 energized by electrical signals from the engine computer, and the magnetic junction 164 to which the second pole piece and second electromagnetic coil are connected. The third path of the magnetic motor is comprised of the magnetic rotor 170 mounted for rotation between a first position and a second position contacting the first pole piece and second pole piece, respectively, an air gap 172 between the magnetic rotor and a third pole piece 174, a permanent magnet 176 connected to the third pole piece, and a fourth pole piece 178 connected between the permanent magnet and the magnetic junction 164. A rotary output shaft 180 is provided on the rotor of the magnetic motor for transferring the rotary motion of the rotor of the magnetic motor to the rotor of the rotary valve 130. Referring to FIG. 17, the first and second pole pieces are preferably arranged to form 30% gaps at the end of the rotor of the magnetic motor, to provide maximum leverage and maximum torque. When the rotor is attracted to either the first pole piece or the second pole piece, the gap between the rotor and one of the pole pieces closes, creating a minimum reluctance path, and the permanent magnetic flux in the third path of the magnetic motor latches the rotor of the magnetic motor in place, as indicated by reference number 182.

The operation of the magnetic motor will be further described with reference to FIGS. 16 and 17. If the permanent magnet is oriented to produce a north pole at the rotor of the magnetic motor, at rest, both the first and second pole pieces would be at south polarity. The latched position then completes the permanent magnet flux path, such that the north polarity end of the rotor is magnetically latched to the south polarity of the pole piece which the magnetic rotor contacts. In FIG. 17, the magnetic rotor is shown latched to the first pole piece 160, so that in order to move the magnetic rotor from the position shown to latch with the second pole piece, the second electromagnetic coil 168 is pulsed with direct current. The current flow in the second electromagnetic coil is preferably phased to produce a strong south pole at the second pole piece 166. When this occurs the second pole piece attracts the magnetic rotor, and since the first pole piece is on the opposite end of the magnetic path of the second electromagnetic coil 168, the first pole piece assumes a north polarity. Since the magnetic rotor is permanently provided with a north polarity by the permanent magnet, the magnetic rotor is repelled from the first pole piece, and is attracted to the second pole piece. At the same time, the north polarity flux from the second electromagnetic coil 168 enters the third path through the junction 164, reinforcing the permanent magnet, and strengthening the north polarity of the rotor. The magnetic rotor is then very strongly urged to close the gap with the second pole piece, and once this gap is closed, and the coil electrical pulse has ended, the permanent magnetic flux from the third magnetic path latches the magnetic rotor in contact with the second pole piece. If the electromagnetic coil 162 is then pulsed, the opposite action occurs, with the first pole piece acquiring a strong south polarity, and the second pole piece acquiring a north polarity, and the permanent magnet and magnet rotor receiving reinforcement of the north polarity. The second pole piece then repels, and the first pole piece attracts the magnetic rotor, and the permanent magnet again latches the magnetic rotor to the new position at the first pole piece. As should be readily apparent, the permanent magnet may also be installed to produce a south polarity at the rotor, at which both of the electromagnetic coils require current flow phased to produce north polarity at the first and second pole pieces. The resulting functions will then be the same as described above, with all of the magnetic polarities described reversed.

Testing of the three path rotary latched magnetic motor has shown that the motor is capable of very high speed operation. With a rotation cyclic angle of 9%, cyclic rates of 260 Hertz can be achieved with 12 volts, 5 ampere electrical pulses of 1.0 ms duration (0.06 watt - seconds). At the 260 Hertz rate, the magnetic motor drew a steady operational current of 1.172 RMS amperes.

Figure 18:
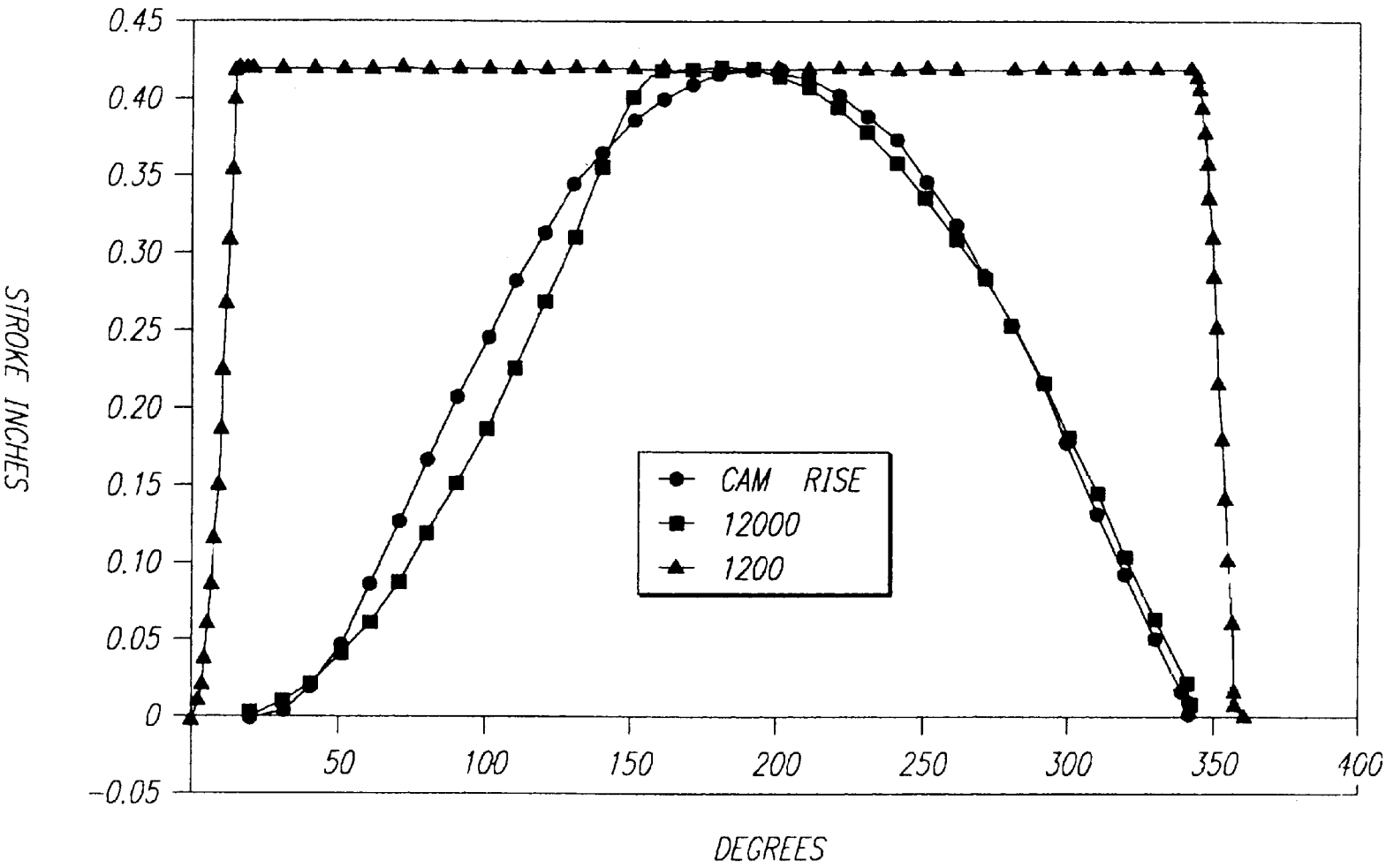
FIG. 18 is a graph comparing operating speeds of valves driven by a mechanical camshaft and valves driven by the reciprocating valve actuation and control system of the invention.

The improvement in the speed of operation of the reciprocating valve actuation and control system of the invention can be readily appreciated with reference to FIG. 18, comparing valve speeds of a mechanical camshaft driven engine and the camless engine valve control system of the invention. The graph shows the length of the valve stroke in inches vs. degrees of rotation of a mechanical camshaft. When graphed, the cycle of opening and closing of a valve driven by a mechanical camshaft will display a shape similar to a sine curve. The period (as measured in crankshaft degrees) remains constant for any engine load or rpm. However, the cycle of opening and closing of valves driven by the reciprocating valve actuating and control system of the invention operates much faster. Designed to match valve opening rates at the maximum engine rpm, the valve actuation and control system of the invention opens the valve at this same rate regardless of engine operating conditions. Thus, the valve actuation and control system of the invention will match the valve rate at a maximum rpm of an engine, but will be faster at all lesser engine speeds. Because of this improved speed, the reciprocating valve actuation and control system of the invention allows greater flexibility in programming valve events, allowing for improved low end torque, lower emissions and improved fuel economy.

The reciprocating valve actuation and control system has the ability to alter the valve cyclical stroke number (i.e., 2 cycle) to a desired valve cycle combination. It is therefore conceivable to start and run an engine in standard 4 cycle mode, then change over at some time to 2 cycle mode and effectively double the potential available torque.

The reciprocating valve actuation and control system also has the ability to control the effective engine speed without the use of a throttle valve. This is accomplished by controlling the valve duration from its idle duration to its maximum torque duration as a function of the desired throttle position. This allows simplification of the induction system and allows for a more compact engine design. The throttle control abilities also provide the ability to control an engine's volumetric efficiency under certain conditions, and allow the engine to have a softer RPM limiting function.

Upon sensing ignition switch shutoff of system power failure, the reciprocating valve actuation and control system and valve spring puts the valve in the most desirable "generally closed" state, so that the valve positions are not ambiguous and will thus protect engines from valve/valve or piston valve contact. After the valve positions are guaranteed, the reciprocating valve actuation and control system will turn off the power to itself, and operations will cease.

The stored energy in the accumulator can be used for engine power bursts. During these brief power bursts, the hydraulic pump can be disengaged, allowing the valves to be powered solely from stored energy from the accumulator with additional energy savings derived by not operating the hydraulic pump. Also, during braking, some energy that would normally be absorbed by the vehicle friction braking system can be stored in the accumulator. This is possible because the crankshaft (ultimately) is connected to the vehicle wheels and can drive the hydraulic pump to fill the accumulator for future hydraulic valve actuation.

A controller chip can eliminate the need for a half crankshaft speed cam position sensor along with all of its mechanical and electrical interfaces. (Typically the distributor or cam position sensor.) The chip can calculate and determine overlap and firing sequencing of a 2, 4, 5, 6, etc. cycle engine during the start-up sequencing.

While the preferred embodiment describes the use of engine oil from the engine lubrication circuit, an alternative would be a secondary fluid (e.g. diesel fuel, ATF, steering fluid, etc.). The hydraulic fluid may be also be a separate system with another fluid type on a separate fluid circuit. Also, the fluid return reservoir may be the engine crankcase, or a separate and different location.

By use of the invention, multiple intake or exhaust valves of a cylinder need not open at the same time. A delay of even a small amount can off-load the driver electronics and reduce peak current load. This will allow smaller current traces on the circuit board and prevent ringing of the power transistors. The delay of the intake valves opening in a multi inlet valve cylinder can enhance the swirl effect. Both opening and closing events of the set of valves can be mapped to enhance various operating characteristics. This effect can also be combined with the use of shaped and directed inlet ports. The invention can also enhance mechanical simplicity of the intake system. Installing a Pedal Position Sensor at the velocity/accelerator pedal will allow simplification of the induction system by eliminating throttle plates and effectively throttling the engine using only the conventional intake and exhaust valves that open into the cylinder.

Since the invention allows broad control of a variety of combination functions, an internal EGR function can be created by commanding a second set of exhaust valve opening and closing events during the intake sequence. Similarly, the intake valve may be opened and closed several times during the intake or exhaust sequence to promote scavenging and later to follow the piston to promote intake volumetric optimization, and intake and exhaust valves may be dithered to control engine throttling and braking.

Figure 19:
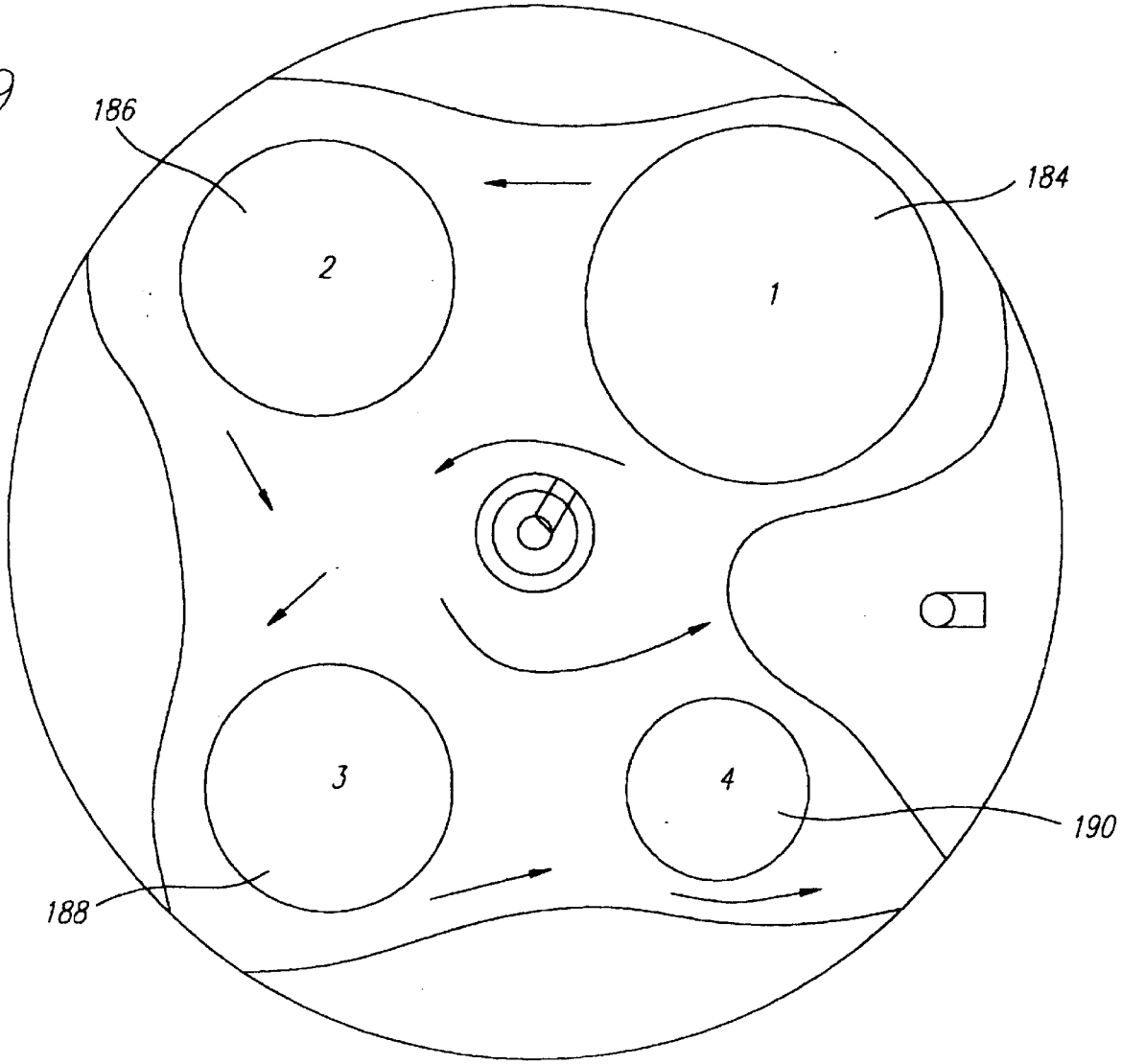
FIG. 19 is a schematic diagram of paired intake and exhaust valves of unequal sizes.

As a further indication of the benefits of the invention, one intake port would be designed for high swirl (lower volume) while a second intake port would be designed for high volume (lower swirl). During throttled conditions, only the high swirl port would be used to optimize combustion efficiency. If exhaust valves are provided as different sizes, the smaller would be opened first so as to substantially lower cylinder pressure prior to opening the second exhaust valve. When both valves are of equal size, either valve could be opened ahead of the second to again lower cylinder pressure before opening the second valve. This sequencing may allow the use of smaller valve actuators and certainly reduced energy to operate the second valve. Engines with both multiple intake and exhaust valves can be made to operate under higher conditions of swirl. Although paired intake and exhaust valves may be of equal size, swirl is maximized by having different sized valves and properly sequencing them. Refer to FIG. 19. Sequence is as follows:

a. #1 Intake valve 184 opens (largest valve)

b. #2 Intake valve 186 opens (smaller valve)

c. #2 Intake valve 186 closes d. #1 Intake valve 184 closes e. Compression and power stroke take place.

f. #4 Exhaust valve 190 opens (smaller valve w/less surface area)

g. #3 Exhaust valve 188 opens (larger valve w/more volume)

h. #3 Exhaust valve 188 closes i. #1 Intake valve 184 opens (overlap begins)

j. #4 Exhaust valve 190 closes (overlap ends)

The invention can also effectively use a bridge in the combustion chamber to assist swirl. In addition to valve size and sequencing to promote higher swirl, the upper combustion chamber may incorporate a "bridge" effectively separating the intake side from the exhaust side in the dome of the combustion chamber. With the "bridge" in place, gases would be better directed to flow in a "swirl" pattern as shown in FIG. 19.

Using the invention, engines having multiple intake or exhaust valves could be start sequenced having only one intake and one exhaust valve operating. The invention permits reprogramming to allow reverse engine rotation by simply inverting one input wire pair. Reverse operation is advantageous to operation of marine equipment having dual outdrives or T-drives, since vehicle torsional accelerations are canceled by reverse rotational engines. This feature would also eliminate the need for reverse gear(s) in the transmission since forward gears would be used to operate in either vehicle direction. This provides an opportunity for multiple reverse gears without added hardware.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A reciprocating valve actuation and control system for the cylinders of an internal combustion engine including a crankshaft and a crankshaft position sensor, comprising:

a poppet valve moveable between a first and second position;

a source of pressurized hydraulic fluid;

a hydraulic actuator including an actuator piston coupled to the poppet valve and reciprocating between a first and second position responsive to flow of the pressurized hydraulic fluid to the hydraulic actuator;

an electrically operated valve controlling flow of the pressurized hydraulic fluid to the actuator;

means for determining the position and direction of rotation of the crankshaft from the electrical outputs of the crankshaft position sensor; and an engine control unit generating electrical pulses for controlling the electrically operated valve.

2. The reciprocating valve actuation and control system of claim 1, wherein engine control unit is operative to command a delay to take place in the opening of multiple intake or exhaust valves.

3. The reciprocating valve actuation and control system of claim 1, the internal combustion engine having a cylinder head and a combustion chamber, and wherein the engine cylinder head has a bridge dividing the combustion chamber.

4. A method for controlling reciprocating valve actuation for the cylinders of an internal combustion engine in a reciprocating valve actuation and control system, the system including a poppet valve moveable between a first and second position; a source of pressurized hydraulic fluid; a hydraulic actuator including an actuator piston coupled to the poppet valve and reciprocating between a first and second position responsive to flow of the pressurized hydraulic fluid to the hydraulic actuator; and an electrically operated valve controlling flow of the pressurized hydraulic fluid to the actuator; a crankshaft: and a control means controlling the electrically operated valve the method comprising the steps of:

determining the position and direction of rotation of the crankshaft from the electrical outputs of a sin/cosine crankshaft position sensor; and controlling the electrically operated valve with an engine control unit generating electrical pulses.

5. The method of claim 4, wherein the source of pressurized hydraulic fluid comprises an engine driven hydraulic positive displacement pump for supplying the hydraulic fluid pressure, an unloader valve connected in fluid communication with the pump for limiting output pressure of the pump, and an accumulator connected in fluid communication with the pump and the unloader valve for storing a volume of the hydraulic fluid, the method further comprising the step of:

storing hydraulic energy in the accumulator.

6. The method of claim 5, further comprising the step of:

controlling the accumulator in a way that commands the engine driven pump to "run free" or be disconnected during brief power bursts.

7. The method of claim 5, further comprising the step of:

controlling the accumulator in a way that forces the accumulator to be charged during braking.

8. The method of claim 5, further comprising the step of:

controlling the accumulator in a way that forces the accumulator to be charged during the time the vehicle needs to decelerate.

9. The method of claim 4, wherein said step of controlling comprises:

controlling the engine control unit in a way that commands a delay to take place in the opening of multiple intake or exhaust valves in the cylinder.

10. The method of claim 4, further comprising the step of:

the engine control unit controlling the valve timing to create a swirl effect in the combustion chamber.

11. The method of claim 4, further comprising the step of:

mapping the engine control unit in a manner that optimizes the swirl effect.

12. The method of claim 4, wherein said step of controlling comprises:

the engine control unit controlling the valve timing of the intake and exhaust valves of an engine having at least three valves per cylinder, such that the intake and exhaust valves will not open at the same time, and controlling the valve timing of the intake and exhaust valves of the engine to provide a delay to off load driver electronics and reduce peak current load, allowing smaller current traces and preventing ringing of power transistors.

13. The method of claim 4, the engine having a multi-inlet valve cylinder having shaped and directed inlet ports, wherein said step of controlling comprises:

the engine control unit controlling the valve timing to provide a delay of the opening of intake valves, to cause a swirl effect to take place that is augmented by the shaped and directed inlet ports.

14. The method of claim 4, the engine having a multi valve cylinder having first and second exhaust valves, and first and second hydraulic actuators, the second exhaust valve being larger than the first exhaust valve, the first exhaust valve to open being smaller in head diameter, resulting in lower actuation pressure, wherein said step of controlling comprises:

the engine control unit controlling the timing of the valves to create a delay between the opening point of exhaust valves in the multi valve cylinder to reduce the demand placed on the second actuator, to lower horsepower required to drive the larger exhaust second valve.

15. The method of claim 4, the engine having four intake and exhaust valves, wherein said step of controlling comprises:

the engine control unit controlling the timing of the valves in the following sequence:

a. number 1 Intake valve opens (large valve)

b. number 4 Exhaust valve closes (after start up)

c. number 2 Intake valve opens (smaller valve)

d. number 2 Intake valve closes e. number 1 Intake valve closes f. compression and power stroke take place g. number 4 Exhaust valve opens (smaller valve w/less surface area)

h. number 3 Exhaust valve opens (larger valve w/more volume)

i. number 3 Exhaust valve closes j. number 1 Intake valve opens (overlap begins)

k. number 4 Exhaust valve closes (overlap ends).

16. The method of claim 4, the engine control unit commanding a first set of exhaust valve opening and closing events, wherein said step of controlling comprises:

the engine control unit controlling the timing of the valves by commanding a second set of exhaust valve opening and closing events to take place.

17. The method of claim 4, the engine having four intake and exhaust valves, wherein said step of controlling comprises:

the engine control unit controlling the timing of the valves in the following sequence:

a. number 1 Intake valve opens (largest valve)

b. number 2 Intake valve opens (smaller valve)

c. number 2 Intake valve closes d. number 1 Intake valve closes e. compression and power stroke take place f. number 4 Exhaust valve opens (smaller valve w/less surface area)

g. number 3 Exhaust valve opens (larger valve w/more volume)

h. number 3 Exhaust valve closes i. number 1 Intake valve opens (overlap begins)

j. number 4 Exhaust valve closes (overlap ends).

18. The method of claim 4, wherein said step of controlling comprises:

the engine control unit controlling the valve timing by opening and closing the valves several times during the same stroke.

19. The method of claim 4, wherein said step of controlling comprises:

the engine control unit controlling the valve timing by opening and closing the valves several times to control throttling and braking.

20. The method of claim 4, wherein said step of controlling comprises:

the engine control unit controlling the valve timing.

21. The method of claim 4, the method further comprising the step of:

operating valve openings and closings that are correct for forward/reverse crankshaft rotation, based upon the crankshaft position and direction information, to eliminating possible mechanical interference for crankshaft reverse rotation.

22. The method of claim 4, further comprising the step of:

reversing the direction indication by electronically inverting one signal to cause the engine to run backwards.

23. The method of claim 4, the engine being a four cycle engine having a distributor and camshaft, the method further comprising the step of:

dividing the electrical position output of the electrical crankshaft position sensor by two electronically to eliminate costly mechanical components that drive the distributor and camshaft at half speed, and determining the initial timing during startup sequencing for valves, fuel and ignition.

24. The method of claim 4, the method further comprising the step of:

inputting preset default valve, fuel and ignition operating values into registers of the control means upon application of power, to be utilized if the control means fails to operate, allowing operation in emergencies.

25. The method of claim 24, further comprising the step of:

the control means closing any open valves upon application of power to eliminate mechanical interference until correct crankshaft location is determined by a startup sequence.

26. The method of claim 4, further comprising the step of:

the control means inhibiting fuel injection but not ignition during a shut-off command by the operator.

27. The method of claim 26, further comprising the step of:

sequentially commanding all intake and exhaust valves of the engine to close before power termination to the control system, to eliminate any possible mechanical interference after power removal, in order to provide smooth termination, a low pollution termination, or a rapid deceleration termination, depending on the actual valve closure and ignition sequencing.

28. The method of claim 4, further comprising the step of:

comparing whether the electrical crankshaft position and direction outputs of the position sensor are greater than but not equal to desired values that open valves, to allow for commanded valve event value changes asynchronously to crankshaft position without missed events, such as a missed valve open event causing a misfire and greater vibrations, noise and emitted pollution problem.

29. The method of claim 4, further comprising the step of:

comparing whether the electrical crankshaft position and direction outputs of the position sensor are greater than but not equal to desired values that open valves, to allow for commanded valve event value changes asynchronously to crankshaft position without missed events, such as a missed valve closure event causing a mechanical interference problem.

30. The method of claim 4, further comprising the step of:

comparing whether the electrical crankshaft position and direction outputs of the position sensor are greater than but not equal to desired values that open valves, to allow for commanded valve event value changes asynchronously to crankshaft position without missed events, such as a missed fuel injection event causing a misfire and greater mechanical vibrations and noise.

31. The method of claim 4, further comprising the step of:

comparing whether the electrical crankshaft position and direction outputs of the position sensor are greater than but not equal to desired values that open valves, to allow for commanded valve event value changes asynchronously to crankshaft position without missed events, such as a missed ignition event causing a misfire and greater emitted pollution.

32. The method of claim 4, further comprising the step of:

controlling the dynamic performance of the system by newly added dimensions of mapping strategy, consisting of existing mapping of sensory inputs such as gas pedal position, inlet and exhaust manifold and barometric pressures, exhaust gas composition, coolant and ambient air temperatures with ignition timing and fuel injection, along with new dimensions of inlet/exhaust valve timing.

33. The method of claim 32, the engine having individual fuel injectors, the method further comprising the steps of:

controlling the valve actuation solenoids; and controlling the individual fuel injectors, as well as individual spark events on each cylinder used on the system, based up on said sensory input, and based upon multi-dimensional mapping.

34. The method of claim 32, further comprising the step of:

determining if any cylinders are operating unsatisfactorily, based upon use rotational rate measurements.

35. The method of claim 34, further comprising the step of:

the control means disabling defective cylinders entirely, reducing pollution and potential further engine damage, while offering a limited "limp home" operation.

* * * * *